US009303350B2

(12) United States Patent
Park et al.

(10) Patent No.: US 9,303,350 B2
(45) Date of Patent: Apr. 5, 2016

(54) LAUNDRY TREATING APPARATUS AND REMOTE CONTROLLER

(75) Inventors: Hyoungjun Park, Changwon-si (KR); Yanghwan Kim, Changwon-si (KR); Jongmi Choi, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 340 days.

(21) Appl. No.: 13/978,496

(22) PCT Filed: Jan. 6, 2012

(86) PCT No.: PCT/KR2012/000168

§ 371 (c)(1),
(2), (4) Date: Aug. 16, 2013

(87) PCT Pub. No.: WO2012/093897

PCT Pub. Date: Jul. 12, 2012

(65) Prior Publication Data

US 2013/0321136 A1 Dec. 5, 2013

(30) Foreign Application Priority Data

Jan. 6, 2011 (KR) ..... 10-2011-0001538
Jan. 6, 2011 (KR) ..... 10-2011-0001540

(51) Int. Cl.

*D06F 33/02* (2006.01)
*G08C 17/02* (2006.01)
*D06F 39/00* (2006.01)

(52) U.S. Cl.

CPC ..... *D06F 33/02* (2013.01); *G08C 17/02* (2013.01); *D06F 39/005* (2013.01); *D06F 39/006* (2013.01); *D06F 2210/00* (2013.01); *D06F 2216/00* (2013.01); *G08C 2201/93* (2013.01)

(58) Field of Classification Search

CPC ... D06F 33/02; D06F 39/005; D06F 2216/00; D06F 39/006; D06F 2210/00; G08C 17/02; G08C 2201/93
USPC ..... 340/12.24, 12.54
See application file for complete search history.

(56) References Cited

U.S. PATENT DOCUMENTS

| | | | | |
|---|---|---|---|---|
| 2002/0040505 | A1* | 4/2002 | Tanaka et al. | 8/158 |
| 2002/0128729 | A1* | 9/2002 | Blair et al. | 700/19 |
| 2011/0040417 | A1* | 2/2011 | Wolfe et al. | 700/291 |
| 2011/0202910 | A1* | 8/2011 | Venkatakrishnan et al. | 717/171 |
| 2012/0056827 | A1* | 3/2012 | Kim et al. | 345/173 |

FOREIGN PATENT DOCUMENTS

| | | |
|---|---|---|
| JP | 2006-197978 | 8/2006 |
| JP | 2007-236538 | 9/2007 |
| JP | 2009-028069 | 2/2009 |

* cited by examiner

*Primary Examiner* — Edwin Holloway, III
(74) *Attorney, Agent, or Firm* — Dentons US LLP

(57) ABSTRACT

Provided is a laundry handling apparatus. The laundry handling apparatus includes a display part for displaying information and a control part for controlling the display part. When the display part is turned on, a plurality of screens divided according to contents are displayed on the display part. At least one of course selection screen for selecting a course and a function selection part for selecting an additional function except for the course selection is displayed on one of the plurality of screens.

18 Claims, 55 Drawing Sheets

LAUNDRY TREATING APPARATUS AND REMOTE CONTROLLER

This application is a 35 USC §371 National Stage entry of International Application No. PCT/KR2012/000168 filed Jan. 6, 2012, and claims priority of Korean Application Nos. 10-2011-0001538 filed Jan. 6, 2011, and 10-2011-0001540 filed Jan. 6, 2011, which are hereby incorporated by reference in their entirety.

TECHNICAL FIELD

The present disclosure relates to a laundry handling apparatus and a remote controller.

BACKGROUND ART

In general, laundry handling apparatuses are apparatuses for handling clothes through a washing process. Such a laundry handling apparatuses may be divided into a washer for washing clothes and a dryer for drying the washed clothes.

Laundry handling apparatuses according to a related art could simply perform only its innate functions. However, needs of additional functions except for the handling of clothes are being increased in recent years.

DISCLOSURE

Technical Problem

Embodiments provide a laundry handling apparatus which displays information related to energy as well as information related to innate laundry handling functions.

Embodiments also provide a remote controller which remotely monitors or controls a laundry handling apparatus.

Technical Solution

In one embodiment, a laundry handling apparatus includes: a display part for displaying information; and a control part for controlling the display part, wherein, when the display part is turned on, a plurality of screens divided according to contents are displayed on the display part, and at least one of course selection screen for selecting a course and a function selection part for selecting an additional function except for the course selection is displayed on one of the plurality of screens.

In another embodiment, a remote controller for controlling or monitoring a component comprising at least a laundry handling apparatus includes: a display part for displaying information about the component; and a control part for controlling an operation of the display part, wherein the display part comprises a first user interface (UI) for remotely controlling the component and at least one second user interface (UI) for performing a function except for the remote control.

The details of one or more embodiments are set forth in the accompanying drawings and the description below. Other features will be apparent from the description and drawings, and from the claims.

Advantageous Effects

According to the embodiment, since the laundry handling apparatus may communicate with the communication component, the laundry handling apparatus may recognize the power cost. As the laundry handling apparatus recognizes the power cost, the power cost may be displayed on the display part. Thus, the user may operate the laundry handling apparatus in a time zone at which the power cost is inexpensive to reduce the power usage cost.

Also, as the laundry handling apparatus recognizes the power cost, the power usage information may be displayed on the display part.

As such, an error of the laundry handling apparatus may be diagnosed, and the diagnosed result may be displayed, and thus, the user may easily confirm the error of the laundry handling apparatus.

Also, since new software may be updated, the additional course or the changed course may be utilized without replacing the laundry handling apparatus with a new laundry handling apparatus.

Also, since the operation state of the laundry handling apparatus may be confirmed through the remote controller, the component may be more effectively controlled (managed).

DESCRIPTION OF DRAWINGS

FIG. 7 is a view illustrating an example of a displayed screen when the smart grid selection part is selected on the screen of FIG. 5 in a state where the smart grid function is turned on.

MODE FOR INVENTION

Reference will now be made in detail to embodiments of the present disclosure, examples of which are illustrated in the accompanying drawings.

Figure 1:
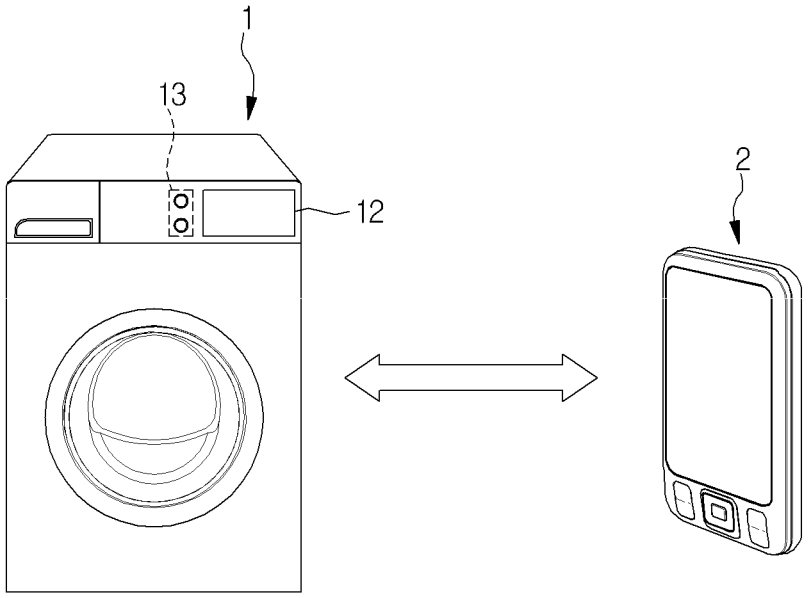
FIG. 1 is a schematic view of a network device including a laundry handling apparatus according to an embodiment.
Figure 2:
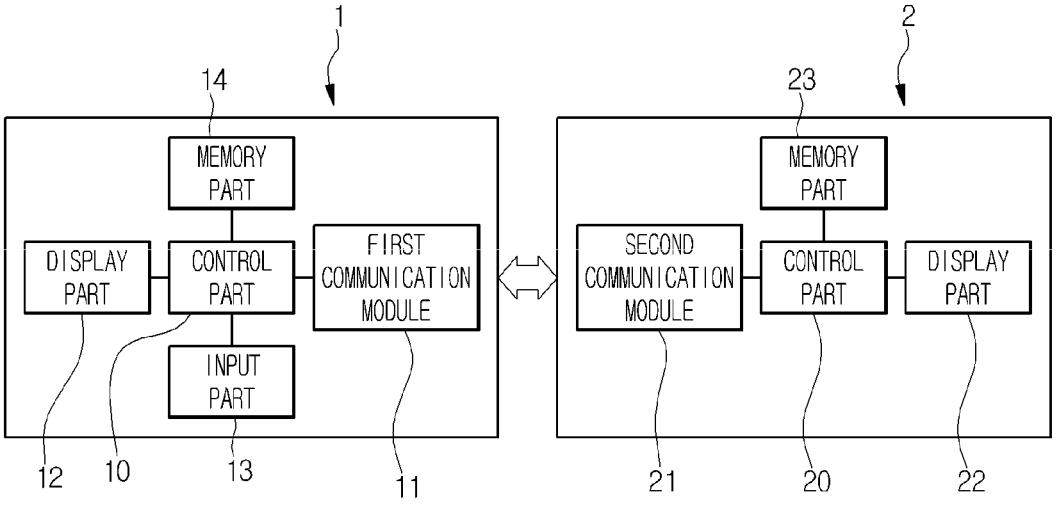
FIG. 2 is a block diagram of the network device including the laundry handling apparatus according to an embodiment.

FIG. 1 is a schematic view of a network device including a laundry handling apparatus according to an embodiment. FIG. 2 is a block diagram of the network device including the laundry handling apparatus according to an embodiment.

Referring to FIGS. 1 and 2, a network device including a laundry handling apparatus according to an embodiment includes a laundry handling apparatus 1 and a communication component 2 communicating with the laundry handling apparatus 1 through a wire or wirelessly communicating with the laundry handling apparatus 1.

The laundry handling apparatus 1 may include a washing machine or a dryer. The present disclosure is not limited to a kind of laundry handling apparatus 1. Hereinafter, although the laundry handling apparatus 1 includes the washing machine as an example, the contents related to the washing machine may be equally applied to the dryer.

The communication component 2 may be a remote controller for remotely controlling home appliances or the laundry handling apparatus 1. The remote controller may be a smart phone or a portable PC.

The laundry handling apparatus 1 may transmit its information to the communication component 2 and receive energy-related information (hereinafter, referred to as "energy information") and an operation command from the communication component 2.

The laundry handling apparatus 1 may include a first communication module 11 directly or indirectly communicating with the communication component 2, a display part 12 for displaying various types of information, an input part 13 for inputting a command, a memory part for storing various types of information, and a control part 10 for controlling at least the display part 12. The control part 10 may control an overall operation of the laundry handling apparatus 1.

The display part 12 may display at least one of status information of the laundry handling apparatus 1, energy information received from the communication component 2, additional information (that will be described later) except the energy information, diagnosis information, and software update information. The display part 12 may include a touch screen for inputting a command on a displayed screen thereof through a touch manner.

The input part 13 may include at least power button and a start/stop button. Alternatively, the input part 13 may be realized on the display part 12. That is, a power on/off command and a start or stop command may be inputted on the display part 12.

The memory part 14 may store at least one of the status information of the laundry handling apparatus 1, the energy information received from the communication component 2, the additional information except the energy information, the diagnosis information, and the updated software information.

The communication component 2 may include a second communication module 21 communicating with the first communication module 11, a display part 22 for displaying various information, a memory part 23 for storing the various information, and a control part 20 for controlling at least the display part 22.

The display part 22 may display information of the communication component 2 and information of the laundry handling apparatus 1. The memory part 23 may store the information of the communication component 2 and the information of the laundry handling apparatus 1. The information of the laundry handling apparatus 1 may include an operation of the laundry handling apparatus 1 or energy information related to the operation of the laundry handling apparatus 1 and additional information except for the energy information.

For example, each of the first and second communication modules 11 and 21 may be a WiFi module. However, the present disclosure is not limited to a communication manner of each of the communication modules. For example, each of the communication module may be a Bluetooth module or a Zigbee module.

The first and second communication modules 11 and 21 may directly communicate with each other. That is, the first and second communication modules 11 and 21 may directly communicate with each other using a WiFi-direct technology or an Ad-Hoc mode (or network) without using a wireless access point. In detail, the WiFi-direct technology represents a technology through which communication modules communicate with each other at a fast rate using a communication standard such as WiFi 802.11a/b/g/n, irrespective of the installation of the access point. That is, the laundry handling apparatus 1 and the communication component 2 may communicate with each other without using the access point.

The Ad-Hoc mode (or the Ad-Hoc network) may be a network which is constituted by only a mobile host without having a fixed wired network. Thus, since the movement of the host is not limited and a wired network and a base station are not required, the Ad-Hoc mode (or the Ad-Hoc network) has a fast net composition and inexpensive. That is, the first and second communication modules 11 and 21 may communicate with each other without using the access point. Thus, in the Ad-Hoc mode, the laundry handling apparatus 1 and the communication component 2 may wirelessly communicate with each other without using the access point.

The Bluetooth communication is widely known near field communication. That is, wireless communication may be allowable within a specific range through a pairing process between the Bluetooth module connected to the laundry handling apparatus 1 and the Bluetooth module connected to the communication component 2.

Alternatively, the first and second communication modules 11 and 21 may communicate with each other through the access point or through an access point and a server (e.g., web server).

Figure 3:
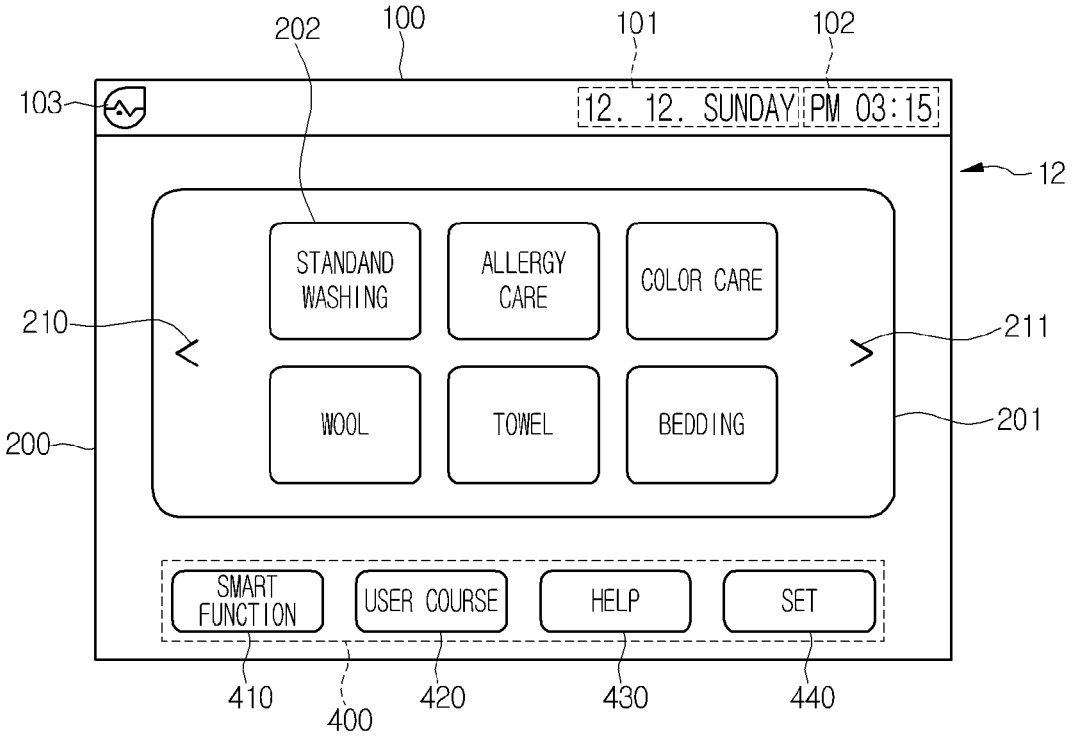
FIG. 3 is a view illustrating an example of a display part of the laundry handling apparatus according to an embodiment.

FIG. 3 is a view illustrating an example of the display part of the laundry handling apparatus according to an embodiment.

Referring to FIGS. 2 and 3, a screen displayed on the display part 12 may include a first screen 100 and a second screen 200. For example, when the laundry handling apparatus 1 is turned on (or the display part 12 is turned on), the screen illustrated in FIG. 3 may be displayed. For example, the first screen 100 and the second screen 200 may be vertically or horizontally disposed with respect to each other. The first and second screens 100 and 200 may be screens independent apart from each other or screens classified according to displayed contents.

At least one of date information 101, time information 102, and smart grid function on/off information 103 may be displayed on the first screen 100. The smart grid function on/off information may be varied according to on/off states. For example, color, brightness, chroma, etc., of the displayed smart grid function information may be varied according to on/off states.

When the smart grid function is turned on, the laundry handling apparatus 1 (or at least the display part) may be operated on the basis of the energy information. The operation of the laundry handling apparatus 1 on the basis of the energy information may represent that the laundry handling apparatus 1 performs a course on the basis of the energy information or displays the energy information. Alternatively, the laundry handling apparatus 1 may be operated on the basis of additional information except for the energy information. The energy information and the additional information except for the energy information may be received from the communication component 2.

The energy information may be information related to one of energy sources such as electricity, water, and gas. In the current embodiment, the energy information is exemplified as information related to electricity. For example, examples of the electricity-related information may include time-based pricing, curtailment, grid emergency, grid reliability, energy increment, energy generation amount, operation priority, and energy consumption amount. In the current embodiment, energy-related cost may be referred to as energy cost.

That is, the energy information may be classified into cost information (energy cost) and information (the curtailment, the grid emergency, the grid reliability, the energy generation amount, the energy increment, the operation priority, and energy consumption amount) except for the cost. The energy information may be classified into scheduled information previously generated on the basis of previous information and real time information varying in real-time. The scheduled information and the real time information may be classified by whether information (of future) after the current time is predicted.

Also, the energy information may be classified into time-of-use (TOU) information, critical-peak-pattern (CPP) information, and real-time-pattern (RTP) information according to a change pattern of data depending on a time. Also, the energy information may be changed according to a time.

According to the TOU information, time-based electricity cost (e.g., cost per unit power) may be changed in phases. According to the CPP information, electricity costs are changed in phases or in real-time according to time, and are emphasized at a specific time point. That is, normal costs of the CPP pattern may be lower than those of the TOU pattern. However, the costs of the CPP pattern may be significantly higher at a specific time point than those of the TOU pattern. According to the RTP information, the time-based electricity cost may be changed in real-time.

The energy information may be transmitted or received as true or false signals such as Boolean, or actual price information may be transmitted or received. Alternatively, the energy information may be leveled in plurality and then the leveled energy information may be transmitted or received.

When the laundry handling apparatus 1 or the communication component 2 receives the true or false signals such as the Boolean, one signal may be recognized as an on-peak signal, and the other signal may be recognized as an off-peak signal.

On the other hand, the laundry handling apparatus 1 or the communication component 2 may recognize at least one driving information including the electricity cost. Also, the laundry handling apparatus 1 or the communication component 2 may compare the recognized information value to a reference information value to recognize an on-peak and an off-peak.

For example, when the laundry handling apparatus 1 or the communication component 2 recognizes the leveled information or the actual price information, the laundry handling apparatus 1 or the communication component 2 may compare the recognized information value to the reference information value to recognize the on-peak and the off-peak.

Here, the driving-related information value may be at least one of electricity cost, a power amount, a variation of the electricity cost, a variation of a powder amount, a mean value of the electricity cost, and a mean value of the power amount. The reference information value may be at least one of a mean value of the power amount, a mean value of maximum and minimum values of the power information during a predetermined period, a reference variation (for example, an inclination of a power consumption amount per unit time) of the powder information during a predetermined period. The reference information value may be set in real-time or in advance.

The additional information except for the energy information may include at least one of environment information, program update information, time information, operation or status information (e.g., breakdown) of each component, and habit information of a consumer utilizing the laundry handling apparatus 1. The environment information may include the discharge amount of carbon dioxide, a concentration of carbon dioxide within air, a temperature, humidity, the amount of rainfall, whether it rains, solar radiation, and wind quantity.

At least one of a course selection screen 201 for selecting a course and a function selection part 400 for selecting other functions except for the source selection may be displayed on the second screen 200. When the course selection screen 201 and the function selection part 400 are displayed on the second screen 20 at the same time, the function selection part 400 may be displayed on a region except for the course selection screen 201.

A plurality of courses 202 are displayed on the course selection screen 201. Here, the whole courses 202 may be displayed on the course selection screen 201, or a portion of the plurality of courses 202 may be displayed on the course selection screen 201. A user may select one of the plurality of courses 202 displayed on the second screen 200.

When a portion of the plurality of courses 202 is displayed on the course selection screen 201, course moving parts 210 and 211 for confirming non-displayed courses may be additionally displayed. Although the courses moving parts 210 and 211 includes a left moving part 210 and a right moving part 211 in FIG. 2, the course moving parts 210 and 211 may include an upward moving part and a downward moving part. Also, although the plurality of courses are disposed in two rows and three columns in FIG. 3, the present disclosure is not limited to the arrangement of the plurality of courses. When the moving parts 210 and 211 are selected in a case where the plurality of courses are disposed in the two rows and three columns, displayed two courses may disappear and non-displayed two courses may be newly displayed.

The function selection part 400 may include at least one of a smart function selection part 410, a user course selection part 420, a help selection part 430, and a set selection part 440. For example, in FIG. 3, the function selection part 400 includes the smart function selection part 410, the user course selection part 420, the help selection part 430, and the set selection part 440. When the help selection part 430 is selected, information related to usage of the laundry handling apparatus 1 may be displayed. The user course selection part 420 will be described later.

Figure 4:
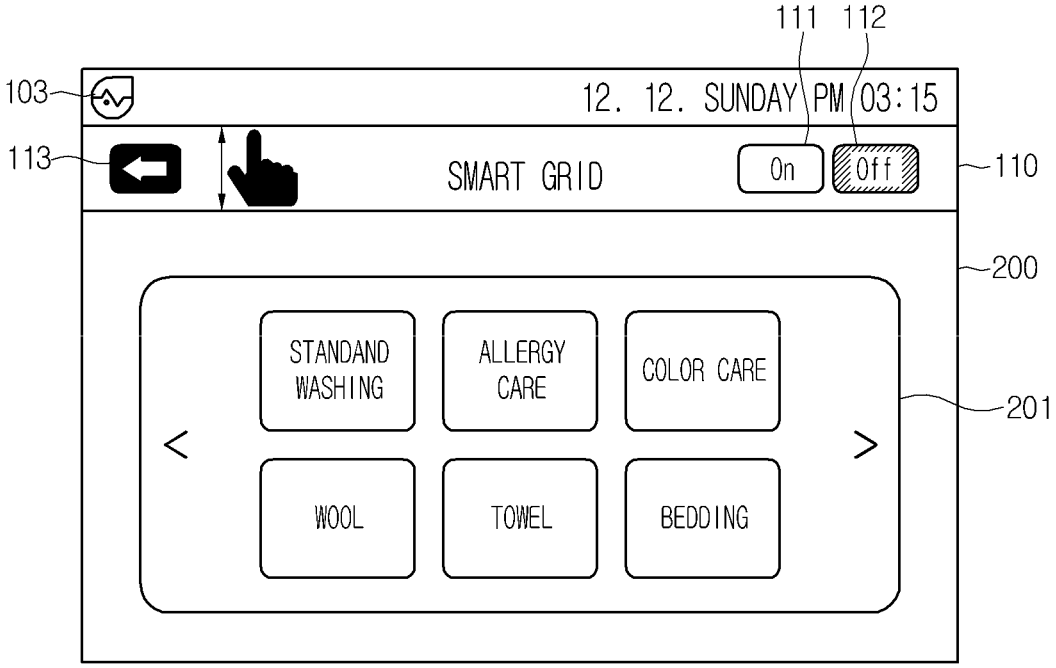
FIG. 4 is a view illustrating an example of a screen for selecting an on/off state of a smart grid function.

FIG. 4 is a view illustrating an example of a screen for selecting an on/off state of a smart grid function.

Referring to FIGS. 3 and 4, when a boundary between the first screen 100 and the second screen 200 or an upper part of the second screen 200 are moved downward while touching the boundary and the upper part on the screen of FIG. 3, a smart grid information screen 110 may be displayed. When the smart grid information screen 110 is displayed, the function selection part 400 may disappear on the second screen 200. An on selection part 111 and an off selection part 112 may be displayed on the smart grid information screen 110. When the on selection part 111 is selected, the smart grid function is turned on. Also, when the off selection part 112 is selected, the smart grid function is turned off.

On the other hand, a single selection part may be displayed on the smart grid information screen 110. Thus, the smart grid function may be turned on or off according to the pushed number of selection part. A previous screen selection part 113 for moving the current screen into the previous screen (see the screen of FIG. 3) may be additionally displayed on the smart grid information screen 110. When the previous screen selection part 113 is selected, the smart grid information screen 110 disappears. Also, when the smart grid information screen 510 is moved upward while touching the smart grid information screen 110, the smart grid information screen 510 may disappear. For another example, when the smart grid information 103 is selected on the screen of FIG. 3, a pop up screen including the on selection part and the off selection part or a pop up screen the single selection part may be displayed.

The smart grid information screen 110 may be a portion of the second screen 200 or a screen separated from the second screen 200.

Figure 5:
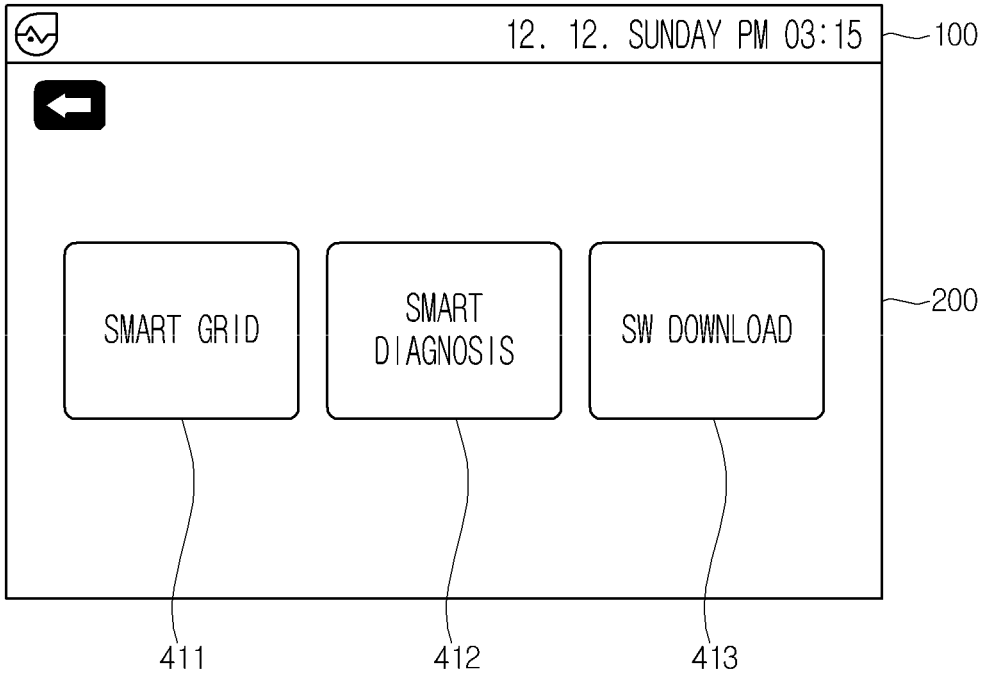
FIG. 5 is a view illustrating an example of a displayed screen when a smart function is selected on the screen of FIG. 3.

FIG. 5 is a view illustrating an example of a displayed screen when the smart function is selected on the screen of FIG. 3.

Referring to FIGS. 3 and 5, when the smart function selection part 410 is selected on the screen of FIG. 3, at least one of a smart grid selection part 411, a smart grid diagnosis selection part 412, and a software download selection part 413 may be displayed on the second screen 200.

That is, the smart function may include at least one of a smart grid function, a smart diagnosis function, and a software download function.

For example, FIG. 5 illustrates the second screen 200 on which the smart grid selection part 411, the smart diagnosis selection part 412, and the software download selection part 413 are displayed. When the smart grid selection part 411 is selected, for example, the energy information may be confirmed. When the smart diagnosis selection part 412 is selected, for example, the diagnosis of the laundry handling apparatus 1 may be performed. When the software download selection part 413 is selected, software may be downloaded from the outside.

Figure 6:
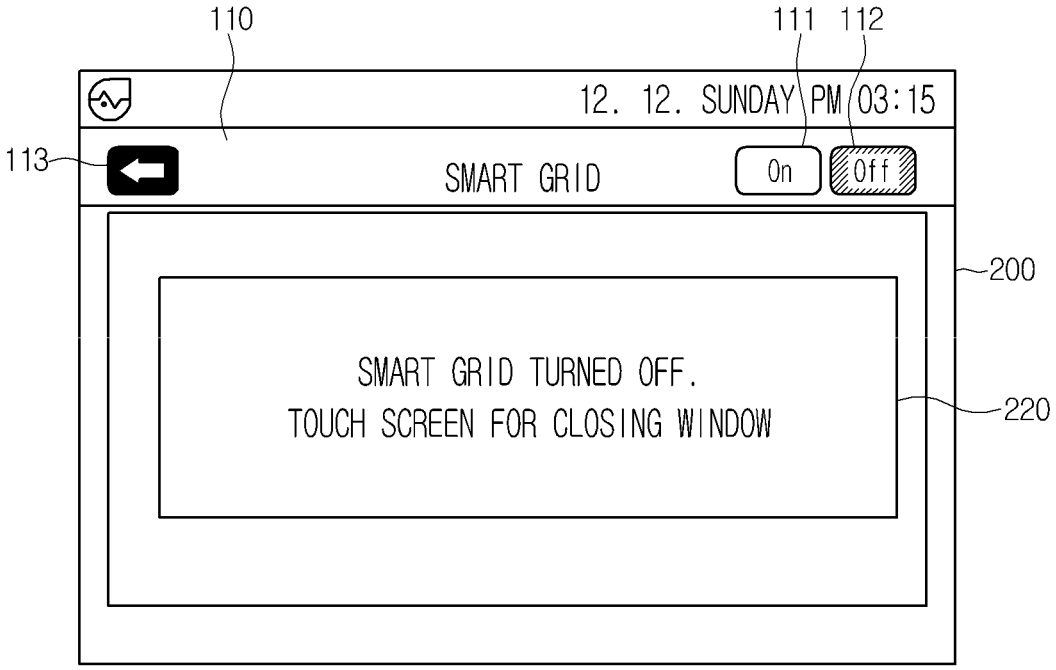
FIG. 6 is a view illustrating an example of a displayed screen when a smart grid selection part is selected on the screen of FIG. 5 in a state where the smart grid function is turned off.

FIG. 6 is a view illustrating an example of a displayed screen when the smart grid selection part is selected on the screen of FIG. 5 in a state where the smart grid function is turned off.

Referring to FIGS. 5 and 6, when the smart grid selection part 411 is selected on the screen of FIG. 5 in the state where the smart grid function is turned off, a smart grid off notice screen 220 may be displayed on the second screen 200. Additionally, the smart grid information screen 110 may be displayed on the second screen 200. For another example, the smart grid information screen 110 independent apart from the second screen 200 may be displayed together with the second screen 200.

The information displayed on the smart grid off notice screen 220 may include, e.g., sentences "Smart grid turned off. Touch screen for closing window". When the smart grid off notice screen 220 is selected, the smart grid notice screen 220 may disappear and then the current screen may return to the screen of FIG. 5.

When the On selection part 111 is selected on the smart grid information screen 110, the smart grid function is turned on. When the smart grid function is turned on, the current screen is switched into a screen of FIG. 7 that will be described later.

Figure 7:
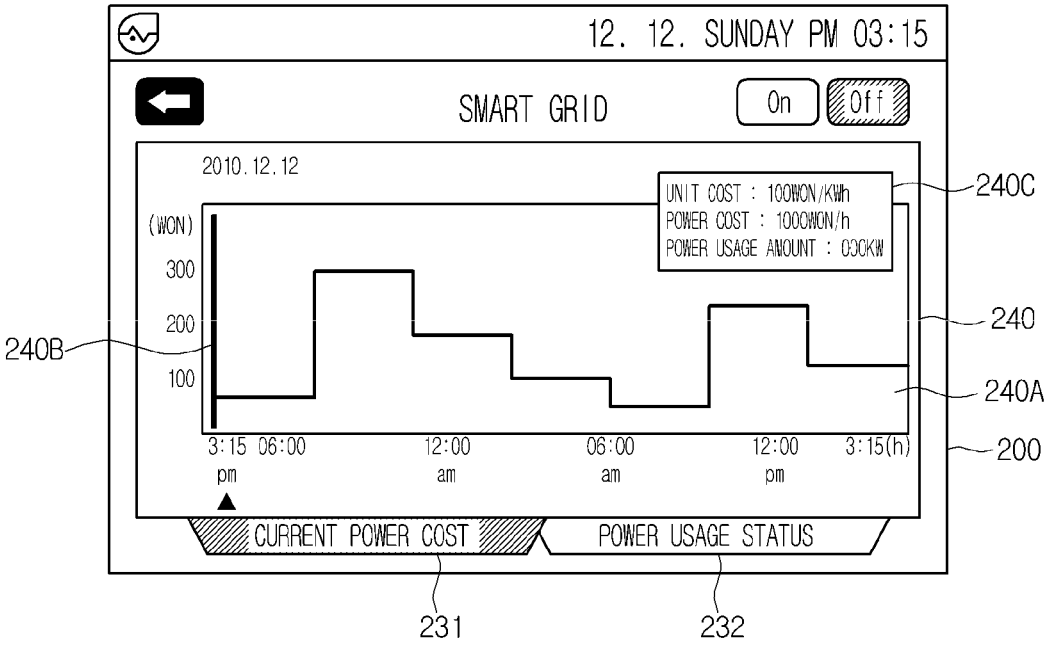

FIG. 7 is a view illustrating an example of a displayed screen when the smart grid selection part is selected on the screen of FIG. 5 in a state where the smart grid function is turned on.

Referring to FIGS. 5 and 7, in the state where the smart grid function is turned on, when the smart grid selection part 411 is selected on the screen of FIG. 5 or the ON selection part 111 is turned on the screen of FIG. 6, a power cost screen 240 may be displayed on the second screen 200. Graph information 240A (e.g., a line graph) related to the power cost may be displayed on the power cost screen 240. The graph information 240A related to the power cost may be hourly cost graph information. In the graph information 240A, a horizontal axis may represent a time, and a vertical axis may represent cost. Also, an initial time (a reference time) on the horizontal axis may be the current time, and the last time may be a time after 24 hours from the current time. That is, a time range may be about 24 hours in the graph information 240A. Also, the graph information 240A may include power cost information during the 24 hours. In the current embodiment, the time range may be manually or automatically changed or set. Thus, the present disclosure is not limited to the time range. The initial time may be disposed on a left side of the screen on which the graph information 240A is displayed, and the last time may be disposed on a right side.

Alternatively, the initial time may be disposed on the right side of the screen on which the graph information 240A is displayed, and the last time may be disposed on the left side.

The hourly cost graph may be divided into a plurality of levels and thus the hourly cost graph having the plurality of levels may be displayed. Also, the hourly cost graph may have colors different from each other for each level.

An operation time display part 240B may be displayed on the power cost screen 240. The operation time display part 240B may be disposed on a position corresponding to the current time of the graph information 240A. The operation time display part 240B may have a line or bar graph shape. Since the initial time is the current time on the horizontal axis, the operation time display part 240B may be disposed to correspond to the current time.

The power cost screen 240 may be periodically updated. For example, the power cost screen 240 may be updated every 15 minutes. Referring to FIG. 7, when a time elapsed from the current time, i.e., 3:15 P.M., is about 15 minutes, the current time (the reference time) may be updated to 3:30 P.M., and the last time may be updated to 3:30 P.M. The present disclosure is not limited to the updating period of the power cost screen 240.

Character information 240C related to the power cost may be additionally displayed on the power cost screen 240. The character information 240C related to the power cost may include at least one of unit cost (cost per unit power), power cost (usage cost per unit time), and a power usage amount. That is, a plurality of information related to the power cost having patterns different from each other may be displayed on the power cost screen 240.

In the state where the smart grid function is turned on, when the smart grid selection part 411 is selected on the screen of FIG. 5 or the ON selection part 111 is selected on the screen of FIG. 6, at least one of the current power cost selection part 231 and a power usage status selection part 232 may be additionally displayed on the second screen 200. For example, FIG. 7 illustrate the current power cost selection part 231 and the power usage status selection part 232. The current power cost selection part 231 and the power usage status selection part 232 may be separately displayed. That is, the current power cost selection part 231 and the power usage status selection part 232 may be different in color, brightness, and chroma. For example, one selection part of the current power cost selection part 231 and the power usage status selection part 232 may be darker than a non-selected selection part on the screen of FIG. 7.

In the state where the smart grid function is turned on, when the smart grid selection part 411 is selected on the screen of FIG. 5 or the ON selection part 111 is selected on the screen of FIG. 6, the power cost screen 240 may be set to be fundamentally displayed on the second screen 200. Thus, the current power cost selection part 231 may be darker than the power usage status selection part 232. On the other hand, in the state where the smart grid function is turned on, when the smart grid selection part 411 is selected on the screen of FIG. 5 or the ON selection part 111 is turned on the screen of FIG. 6, a power usage information screen (that will be described later) may be set to be fundamentally displayed on the second screen 200. The power usage information screen may include at least one of a power usage cost screen and a power usage amount screen.

Figure 8:
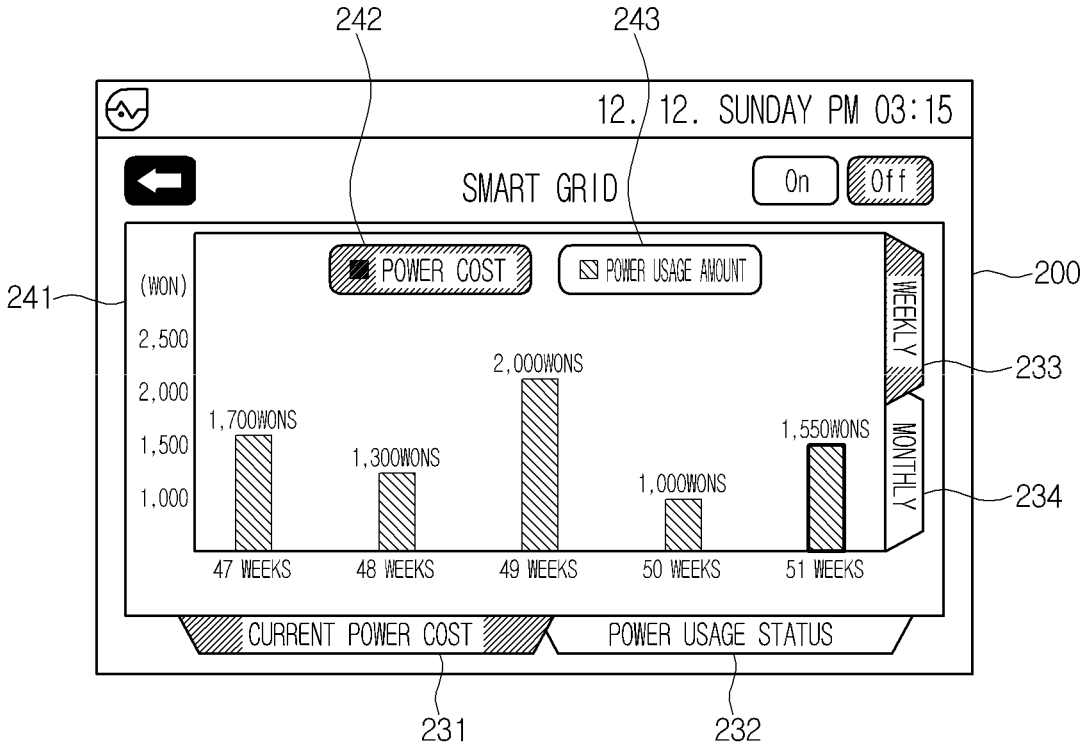
FIG. 8 is a view illustrating an example of a displayed screen when a power usage status selection part is selected on the screen of FIG. 7.

FIG. 8 is a view illustrating an example of a displayed screen when the power usage status selection part is selected on the screen of FIG. 7.

Referring to FIGS. 7 and 8, when the power usage status selection part 232 is selected on the screen of FIG. 7, a weekly power usage cost screen 241 may be displayed. That is, power usage cost may be displayed in a bar graph form on the weekly power usage cost screen 241. However, the present disclosure is not limited to the bar graph form, and thus, weekly power usage cost may be displayed in line graph, character, or numerical form.

A weekly selection part 233 and a monthly selection part 234 may be displayed on the weekly power usage cost screen 241. Also, a power cost selection part 242 for selecting power usage cost and a power usage amount selection part 243 for selecting a power usage amount may be displayed on the weekly power usage cost screen 241.

Power usage cost information for at least two weeks may be displayed on the weekly power usage cost screen 241. Although power usage cost information for recent five weeks is displayed in FIG. 8, the number of displayed weeks is not limited thereto. Information for the latest week may be disposed on the right side, and information for the previous weeks may be sequentially arrayed to the left side from the information for the latest week. On the contrary, the information for the latest week may be disposed on the left side, and the information for the previous weeks may be sequentially arrayed to the right side from the information for the latest week. As a weekly usage cost increases, the length of a bar in a graph may increase.

Power usage cost may be additionally numerically displayed on the weekly power usage cost screen 241 to correspond to the displayed bar graph.

Displayed information for the current week among information for at least two weeks may be different from the displayed information for the previous week in color, brightness, and chroma.

Figure 9:
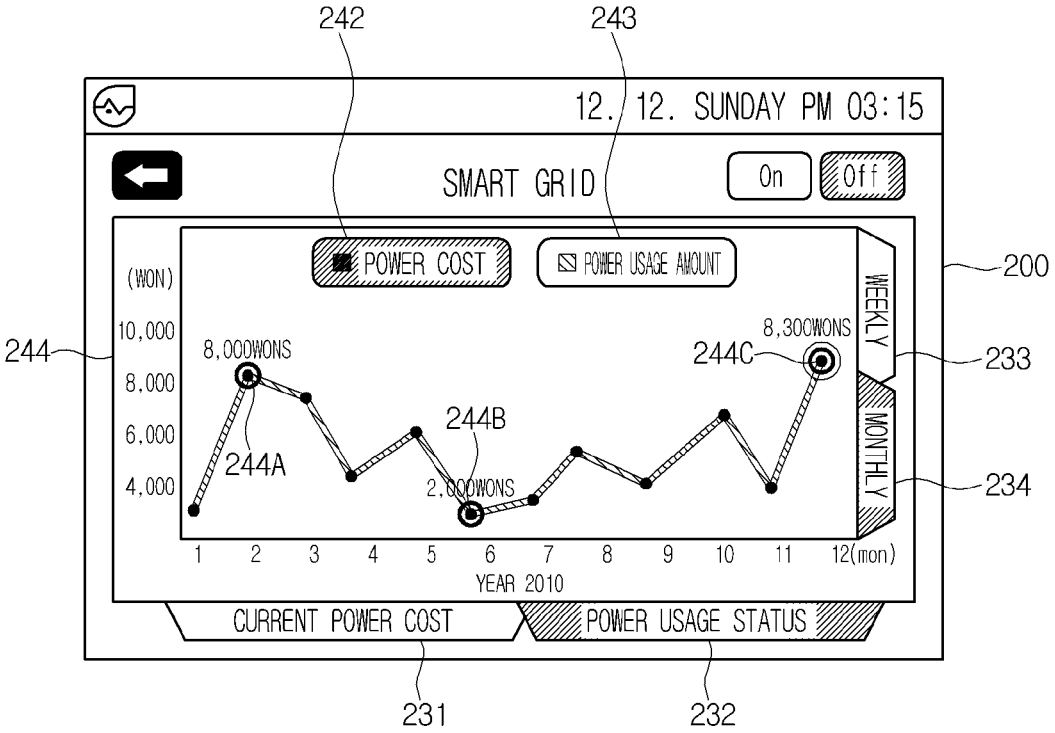
FIG. 9 is a view illustrating an example of a displayed screen when a monthly selection part is selected on the screen of FIG. 8.

FIG. 9 is a view illustrating an example of a displayed screen when a monthly selection part is selected on the screen of FIG. 8.

Referring to FIGS. 7 and 8, when the monthly selection part 234 is selected on the screen of FIG. 8, a monthly power usage cost screen 244 may be displayed. Power usage cost may be displayed in a line graph form on the monthly power usage cost screen 244. However, the present disclosure is not limited to the line graph form, and thus, monthly power usage costs may be displayed in bar graph, character, or numerical form.

Power usage cost information for a plurality of months may be displayed on the monthly power usage cost screen 244. Although power usage cost information for recent twelve months is displayed in FIG. 9, the present disclosure is not limited to the number of displayed months. Information for the latest month may be disposed on the right side, and information for the previous months may be sequentially arrayed to the left side from the information for the latest month. On the contrary, the information for the latest month may be disposed on the left side, and the information for the previous months may be sequentially arrayed to the right side from the information for the latest month.

Information about a highest usage cost month 244A, a lowest usage cost month 244B, and a current month 244C, and power usage costs corresponding thereto may be displayed in the line graph on the monthly power usage cost screen 244.

Figure 10:
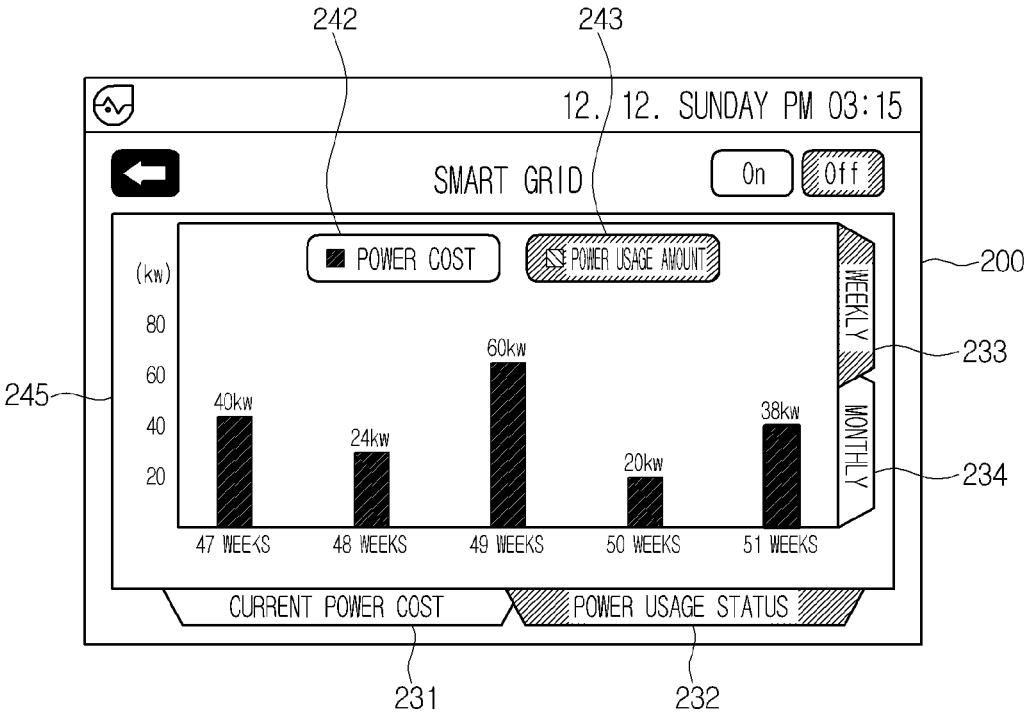
FIG. 10 is a view illustrating an example of a displayed screen when the power usage status selection part is selected on the screen of FIG. 8.

FIG. 10 is a view illustrating an example of a displayed screen when a power usage status selection part is selected on the screen of FIG. 8.

Referring to FIGS. 8 and 10, when the power usage amount selection part 243 is selected on the screen of FIG. 8, a weekly power usage amount screen 245 may be displayed. A power usage amount may be displayed in a bar graph form on the weekly power usage amount screen 245. However, the present disclosure is not limited to the bar graph form, and thus, weekly power usage amounts may be displayed in line graph, character, or numerical form.

The weekly selection part 233 and the monthly selection part 234 may be displayed on the weekly power usage amount screen 245. Power usage amount information for at least two weeks may be displayed on the weekly power usage amount screen 245. Although power usage amount information for recent five weeks is displayed in FIG. 10, the present disclosure is not limited to the number of displayed weeks. Information for the latest week may be disposed on the right side, and information for the previous weeks may be sequentially arrayed to the left side from the information for the latest week. On the contrary, the information for the latest week may be disposed on the left side, and the information for the previous weeks may be sequentially arrayed to the right side from the information for the latest week. As a weekly usage amount increases, the length of a bar in a graph may increase.

Figure 11:
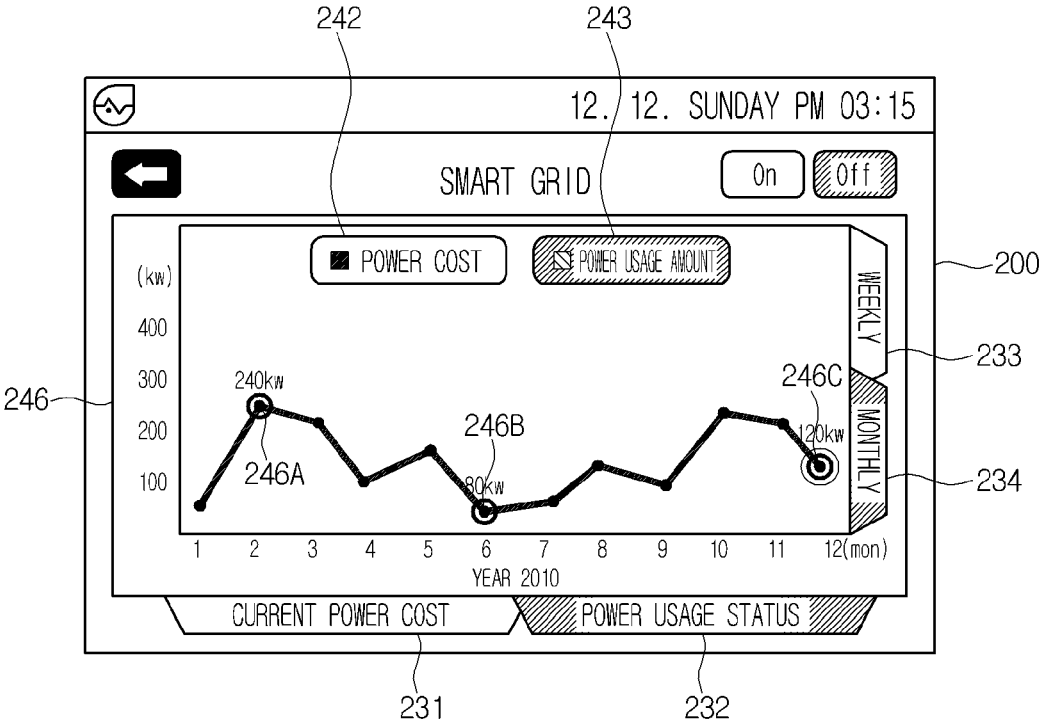
FIG. 11 is a view illustrating an example of a displayed screen when the monthly selection part is selected on the screen of FIG. 10.

FIG. 11 is a view illustrating an example of a displayed screen when the monthly selection part is selected on the screen of FIG. 10.

Referring to FIGS. 10 and 11, when the monthly selection part 234 is selected on the screen of FIG. 10, a monthly power usage amount screen 246 may be displayed. A power usage amount may be displayed in a ling graph form on the monthly power usage amount screen 246. However, the present disclosure is not limited to the line graph form, and thus, monthly power usage amounts may be displayed in bar graph, character, or numerical form.

Power usage amount information for a plurality of months may be displayed on the monthly power usage amount screen 246. Although power usage amount information for recent twelve months is displayed in FIG. 11, the present disclosure is not limited to the number of displayed months. Information for the latest month may be disposed on the right side, and information for the previous months may be sequentially arrayed to the left side from the information for the latest month. On the contrary, the information for the latest month may be disposed on the left side, and the information for the previous months may be sequentially arrayed to the right side from the information for the latest month.

Information about a highest usage cost month 246A, a lowest usage cost month 246B, and a current month 246C, and power usage amounts corresponding thereto may be displayed in the line graph on the monthly power usage amount screen 246.

Although the weekly power usage cost screen 241 is displayed on the screen of FIG. 8 when the power usage status selection part 232 is selected on the screen of FIG. 7, the monthly power usage cost screen 244, the weekly power usage amount screen 245, or the monthly power usage amount screen 246 may be displayed.

Figure 12:
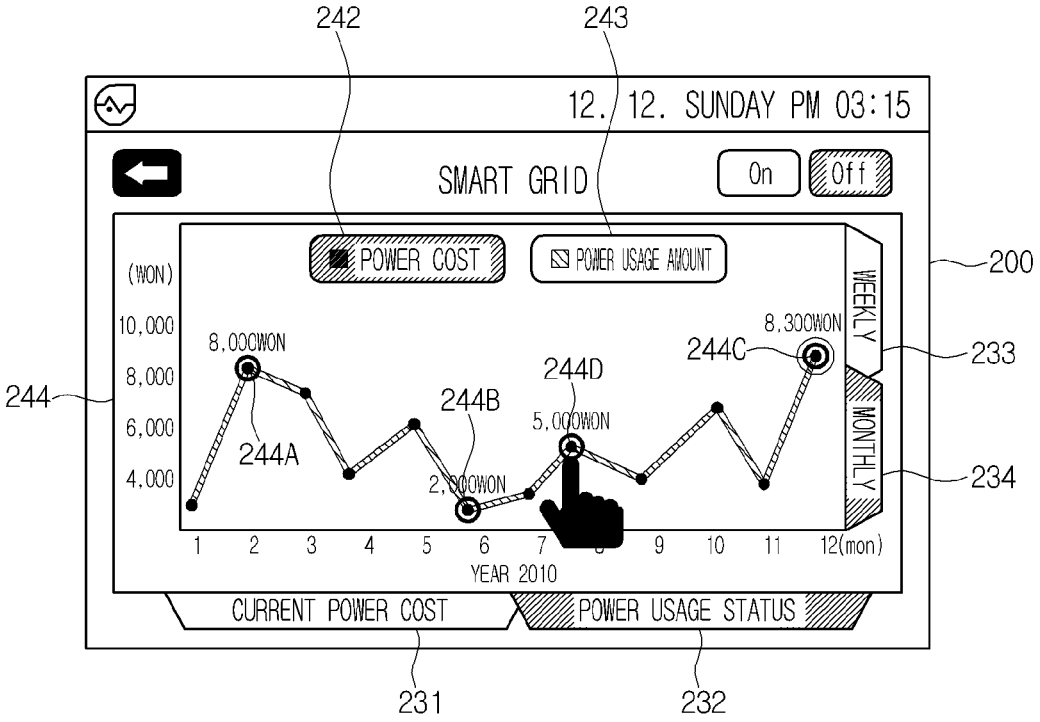
FIG. 12 is a view illustrating an example of a displayed screen when a specific month is selected on the screen of FIG. 9.

FIG. 12 is a view illustrating an example of a displayed screen when a specific month is selected on the screen of FIG. 9.

Referring to FIGS. 9 and 12, when a specific month (e.g., July) is selected in the line graph on the monthly power usage cost screen 244, power usage cost for the selected month may be displayed. After a certain time, the power usage cost for the selected month may disappear. That is, information about the highest usage cost month 244A, the lowest usage cost month 244B, the current month 244C, a selected month 244D, and power usage costs corresponding thereto may be displayed in the line graph on the monthly power usage cost screen 244.

In a same manner as that of FIG. 11, the monthly power usage amount screen 246 of FIG. 11 may be described.

Although not shown above, the first screen and the smart grid information screen in addition to the second screen may be further displayed on the screens of FIGS. 7 to 12.

Since the power cost screen 240, the power usage cost screens 241 and 244, and the power usage amount screens 245 and 246 display power-related information, the above-described screens may be commonly called a power-related information screen. That is, the current embodiment, the power-related information screen may include at least one of the power cost screen 240, the power usage cost screens 241 and 244, and the power usage amount screens 245 and 246.

Although the weekly and monthly information are displayed in FIGS. 8 to 12, daily information may be displayed.

Figure 13:
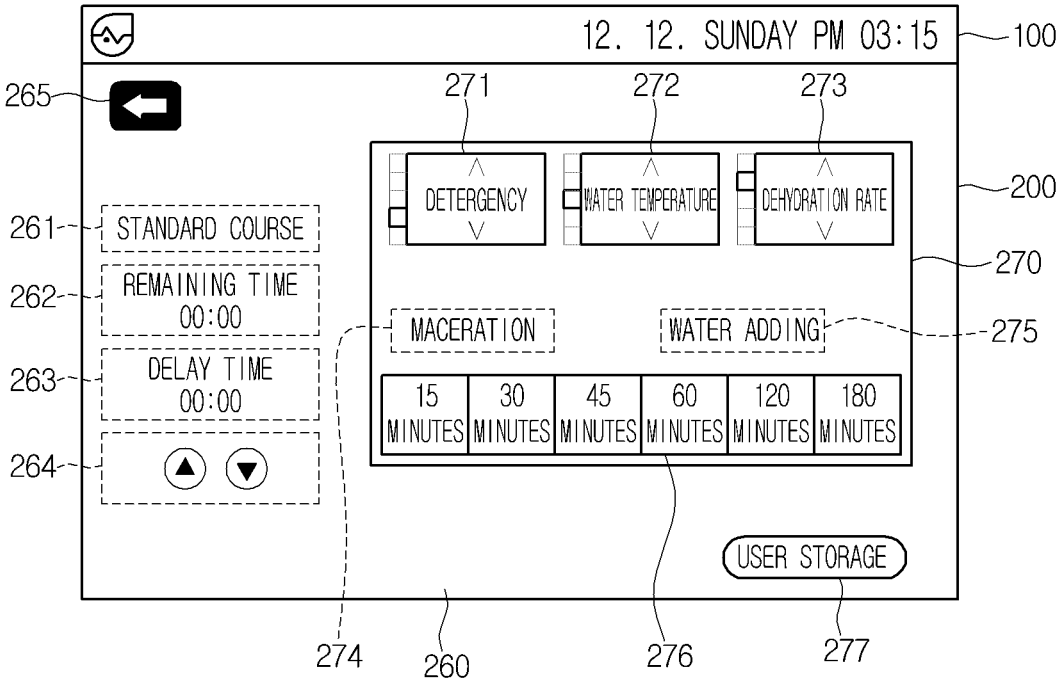
FIG. 13 is a view illustrating an example of a displayed screen when a specific course is selected on the screen of FIG. 3.

FIG. 13 is a view illustrating an example of a displayed screen when a specific course is selected on the screen of FIG. 3.

Referring to FIG. 13, when a specific course (e.g., a standard course) is selected, selected course information 261 and an operation condition input part 270 may be displayed on the second screen 200. Additionally, at least one of remaining time information 262, delay time information 263, delay time set part 264, previous screen selection part 265, and user storage 277 may be displayed on the second screen 200. For example, FIG. 13 illustrates a screen on which the remaining time information 262, the delay time information 263, the delay time set part 264, the previous screen selection part 265, and the user storage 277 are displayed on the second screen 200.

The remaining time information 262, the delay time information 263, the delay time set part 264, the previous screen selection part 265, and the user storage 277 may be displayed on a region 260 of the second screen 200 except for that of the operation condition input part 270.

The remaining time may represent a remaining time until the selected specific course is completed. The remaining time may be previously set for specific courses. For example, the standard course may be set to one hour. Here, the remaining time may be changed according to conditions inputted into the operation condition input part 270.

The delay time information 263 may represent a time point at which a specific course selected at a time point after the current time starts. That is, the delay time information 263 may be delay start time information.

The delay time information 263 may be changed according to the selection of the delay time set part 264. The operation condition input part 270 may include at least one of a detergency selection part 271, a water temperature selection part 272, and a dehydration rate selection part 273. For example, FIG. 13 illustrates the operation condition input part 270 including the detergency selection part 271, the water temperature selection part 272, and the dehydration rate selection part 273.

The operation condition input part 270 may further include at least one of a maceration selection part 274 and a water adding selection part 275. For example, FIG. 13 illustrates the operation condition input part 270 including the maceration selection part 274 and the water adding selection part 275.

When the maceration selection part 274 is selected, a maceration time selection part 276 may be displayed. On the other hand, when the maceration selection part 274 is selected in a state where the maceration selection 274 and the maceration time selection part 276 are displayed together with each other, the maceration time selection part 276 may be activated. In the current embodiment, the activation may represent a state in which selection of a specific selection part is allowable.

The operation conditions which can be selected through the operation condition input part 270 may be previously set for specific courses. That is, when a specific course (e.g., a standard course) is selected on the screen of FIG. 3, the selected course information 261 and the operation condition input part 270 may be displayed on the second screen 200 and the conditions previously set for specific courses may be displayed on the operation condition input part 270. The user may change the operation conditions of the specific courses using the operation condition input part 270. Here, when the user storage 277 is selected in a state where the user inputs an operation condition of a specific course using the operation condition input part 270, the inputted operation condition is recognized as a separate user course to store the operation condition in the memory part (see reference numeral 14 of FIG. 2). That is, the user course may be added to an existing course stored in the memory part (see reference numeral 14 of FIG. 2). When the user course is added, the added user course may be displayed on the course selection screen 201 of FIG. 3 and the user may select the displayed user course. Also, when the user course selection part 420 is selected on the screen of FIG. 3, one or more user course information may be confirmed.

When a specific course (e.g., the standard course) is selected, a first screen in addition to the second screen 200 may be additionally displayed on the display part 12.

Figure 14:
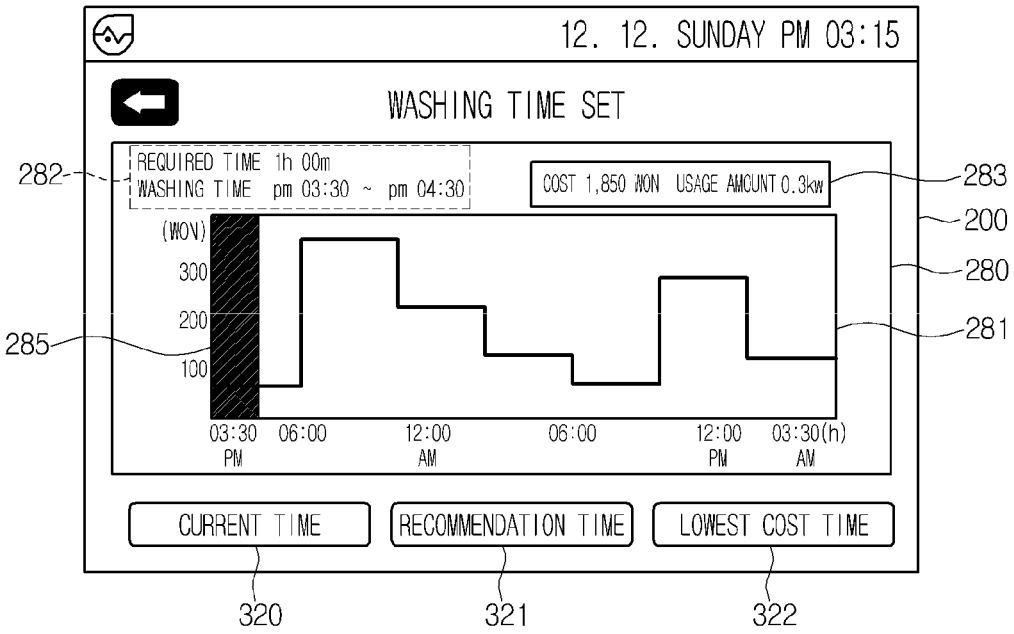
FIG. 14 is a view illustrating an example of a displayed screen when a start command is inputted in a state where the screen of FIG. 13 is displayed.

FIG. 14 is a view illustrating an example of a displayed screen when a start command is inputted in a state where the screen of FIG. 13 is displayed.

Referring to FIGS. 13 and 14, when a start command is inputted on the screen of FIG. 13, a washing time set screen 280 (which may be referred to as an operation time set screen) may be displayed on the second screen 200. At least one of a power cost information screen 281, operation-related time information 282, and operation-related power information 283 may be displayed on the washing time set screen 280. FIG. 13 illustrates a screen on which the power cost information screen 281, the operation-related time information 282, and the operation-related power information 283 are displayed on the washing time set screen 280.

When the start command is inputted on the screen of FIG. 13, the current time selection part 320 for setting an operation time as the current time and at least one recommendation selection part for setting the operation time as a recommended time may be displayed on the second screen 200. The at least one recommendation selection part may include a recommendation time selection part 321 (which may be referred to as a first recommendation selection part) and the lowest cost time selection part 322 (which may be referred to a second commendation selection part).

In detail, the operation-related time information 282 may include at least one of course performance time information, washing start time information, and washing end time information. The operation-related power information 283 may include at least one of power usage cost information and power usage amount information when a corresponding course is performed.

The power cost information screen 281 may include power cost-related graph information (e.g., a line graph) and course performance time information 285. The power cost-related graph information may be hourly cost graph information. In the graph information, a horizontal axis may represent a time, and a vertical axis may represent cost. Also, an initial time (a reference time) on the horizontal axis may be the current time, and a final time may be a time after 24 hours from the current time. That is, a time range may be about 24 hours in the graph information. Also, the graph information may include power cost information during the 24 hours. In the current embodiment, the time range may be manually or automatically changed or set. Thus, the present disclosure is not limited to the time range. An initial time may be disposed at a left side on the screen on which the graph information is displayed, and the last time may be disposed at a right side. Alternatively, the initial time may be disposed on the right side of the power cost information screen 281, and the last time may be disposed on the left side.

The course performance time information 285 may have a bar shape. When the user does not select the delay time set part 264 on the screen of FIG. 13, the course performance time information 285 may be disposed on the left side of the power cost information screen 281. Here, the washing start time of the course performance time information 285 may be disposed to correspond to the current time, and the washing end time may be disposed to correspond to a time zone in which the washing process is complete. Here, the course performance time information 285 displayed on the power cost information screen 281 may have a horizontal length corresponding to the course performance time.

Figure 15:
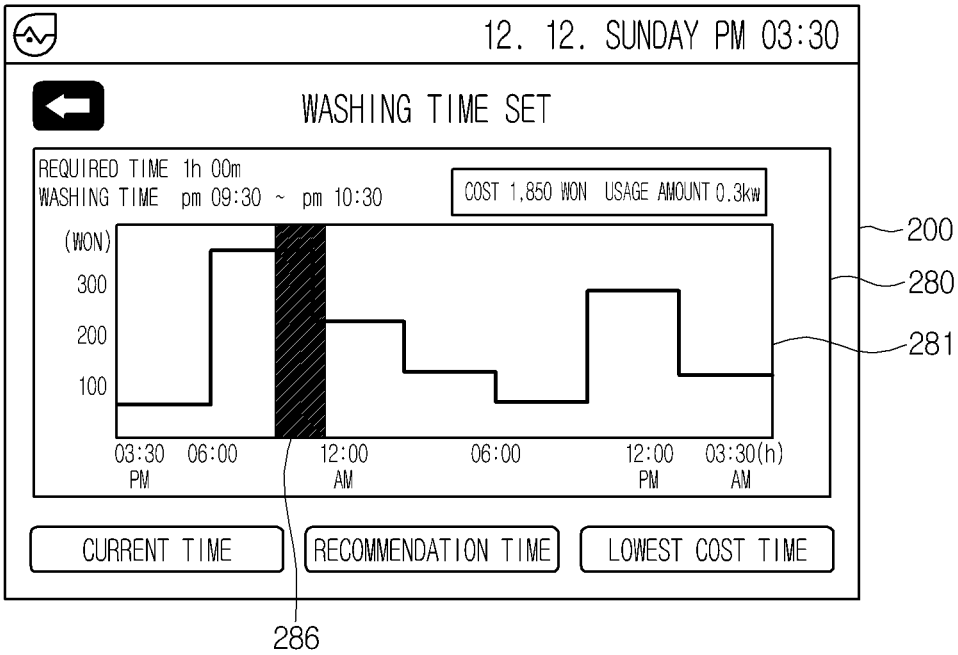
FIG. 15 is a view illustrating an example of a displayed screen when the start command is inputted after a delay time is set on the screen of FIG. 13.

FIG. 15 is a view illustrating an example of a displayed screen when the start command is inputted after a delay time is set on the screen of FIG. 13.

Referring to FIGS. 13 to 15, when the start command is inputted on the screen of FIG. 13 in a state where the delay time is set, the course performance time information 286 may be disposed at a position corresponding to the delay time on the power cost information screen 281. For example, when the current time is about 3:30 P.M. and the user inputs 6 hours as the delay time, a washing start time delayed during the course performance time information 286 may be disposed to correspond to about 9:30 P.M., and a delayed washing end time may be disposed to correspond to about 10:30 P.M. Here, the operation-related time information 282 and the operation-related power information 283 may be varied to correspond to the position (delay time) of the course performance time information 286.

When the commendation time selection part 321 is selected on the screen of FIG. 14, the course performance time information 285 may be moved to a time zone in which power cost is the lowest within a range from the current time to a first reference time. Here, the first reference time may be about 4 hours. For example, in a case where the current time is about 3:30 P.M., the commendation time selection part 321 is selected, the course performance time information 285 may be moved to a time zone in which power cost is the lowest within a range from the current time to about 7:30 P.M. If the power cost is the lowest at the current time, the course performance time information 285 is not moved.

When the lowest cost time selection part 322 is selected on the screen of FIG. 14, the course performance time information 285 may be moved to a time zone in which power cost is the lowest within a range from the current time to a second reference time. Here, the second reference time may be about 24 hours. For example, in a case where the current time is about 3:30 P.M., the commendation time selection part 321 is selected, the course performance time information 285 may be moved to a time zone in which power cost is the lowest within a range from the current time to about 3:30 P.M. If the power cost is the lowest at the current time, the course performance time information 285 is not moved.

Figure 16:
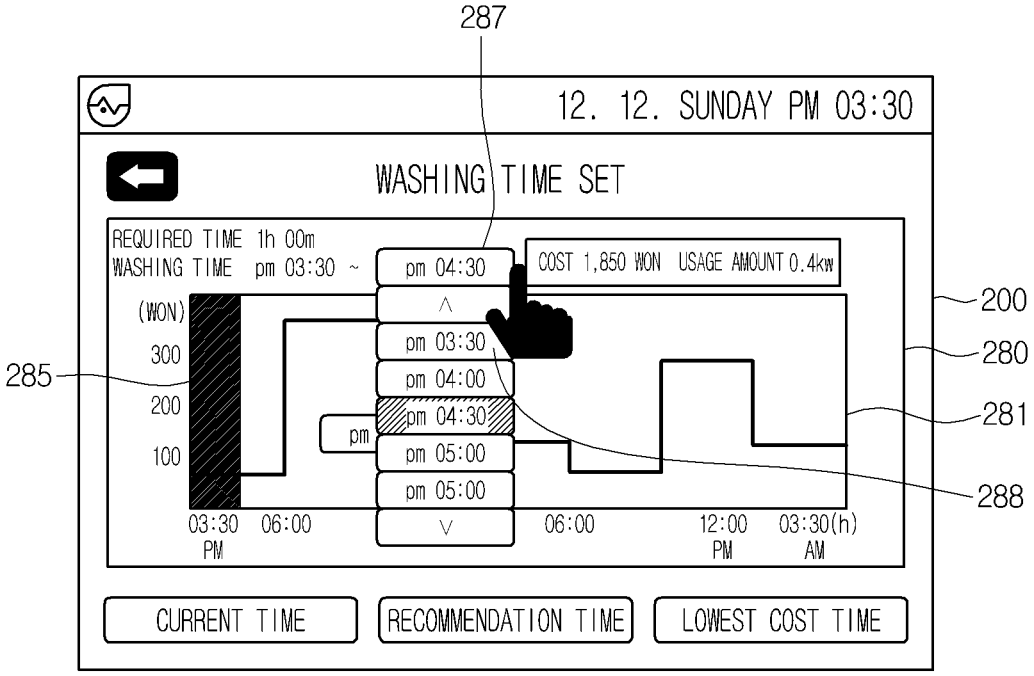
FIG. 16 is a view for explaining a process of changing a washing time according to a first embodiment.

FIG. 16 is a view for explaining a process of changing a washing time according to a first embodiment.

Referring to FIGS. 14 and 16, when the graph of the power cost information screen 281 is selected or the course performance time information 285 is selected on the screen of FIG. 14, at least one of the washing time start information and the washing end time information among the operation-related time information 282 may be activated. When one of the activated information is selected, a time change part 288 for changing a time is displayed. FIG. 16 illustrates a method for changing the washing end time as an example. Also, the washing start time may be changed through the same method. For example, when the activated washing end time information 287 is selected, the time change part 288 is displayed. Here, the end time changed by the time change part 288 may be displayed at a certain time interval. Among this, one may be selected to change the end time. For example, although the certain time may be about 30 minutes in FIG. 16, the present disclosure is not limited to the certain time.

When the washing time is changed, the operation-related time information 282 and the operation-related power information 283 may be varied to correspond to the changed time.

Figure 17:
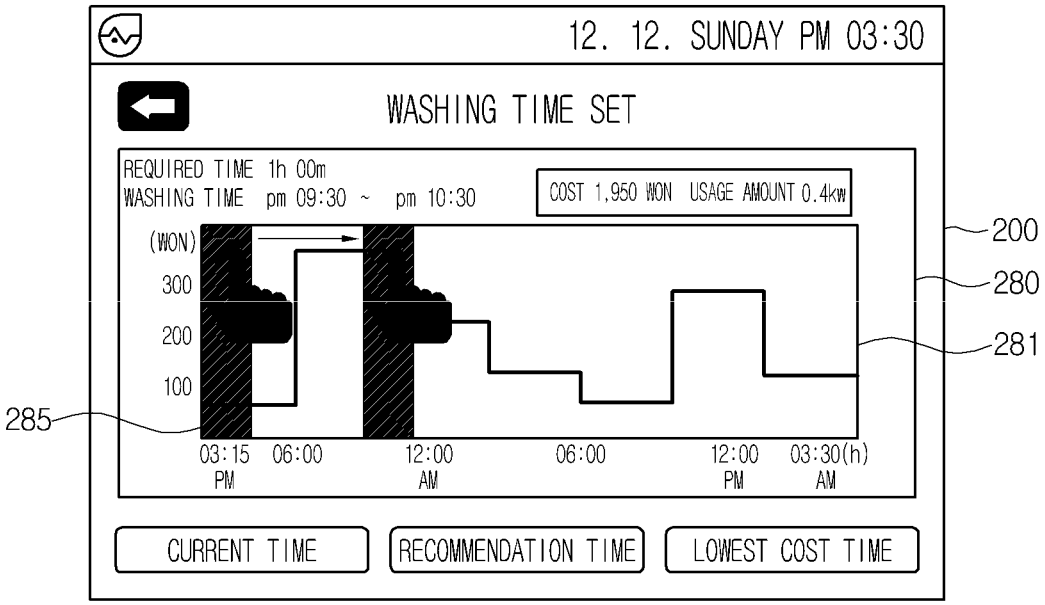
FIG. 17 is a view for explaining a process of changing a washing time according to a second embodiment.

FIG. 17 is a view for explaining a process of changing a washing time according to a second embodiment.

Referring to FIG. 17, when the course performance time information 285 is moved after the course performance time information 285 is selected, the washing time may be changed. For example, when the current time is about 3:30 P.M., the course performance time information 285 may be moved so that the washing start time of the course performance time information 285 corresponds to about 9:30 P.M. When the washing time is changed, the operation-related time information 282 and the operation-related power information 283 may be varied to correspond to the changed time.

Figure 18:
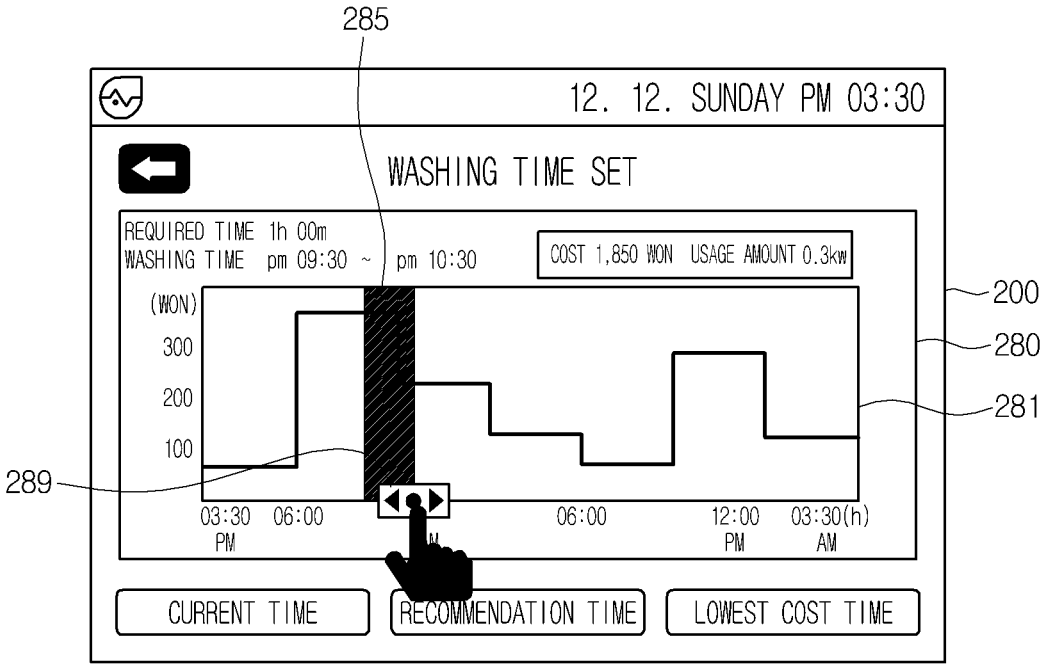
FIG. 18 is a view for explaining a process of changing a washing time according to a third embodiment.

FIG. 18 is a view for explaining a process of changing the washing time according to a third embodiment.

Referring to FIG. 18, when the washing start time (a left portion of the course performance time information) or the washing end time (a right portion of the course performance time information) are selected from the course performance time information 285, a washing time change part 289 is displayed. For example, although the washing time change part 289 for changing the washing end time is displayed in FIG. 18, when the washing start time is selected, the washing time change part 289 for changing the washing start time may be displayed. Also, the washing start time or the washing end time may be changed by a certain time unit using the washing time change part 289. When the washing time is changed, the operation-related time information 282 and the operation-related power information 283 may be varied to correspond to the changed time.

Figure 19:
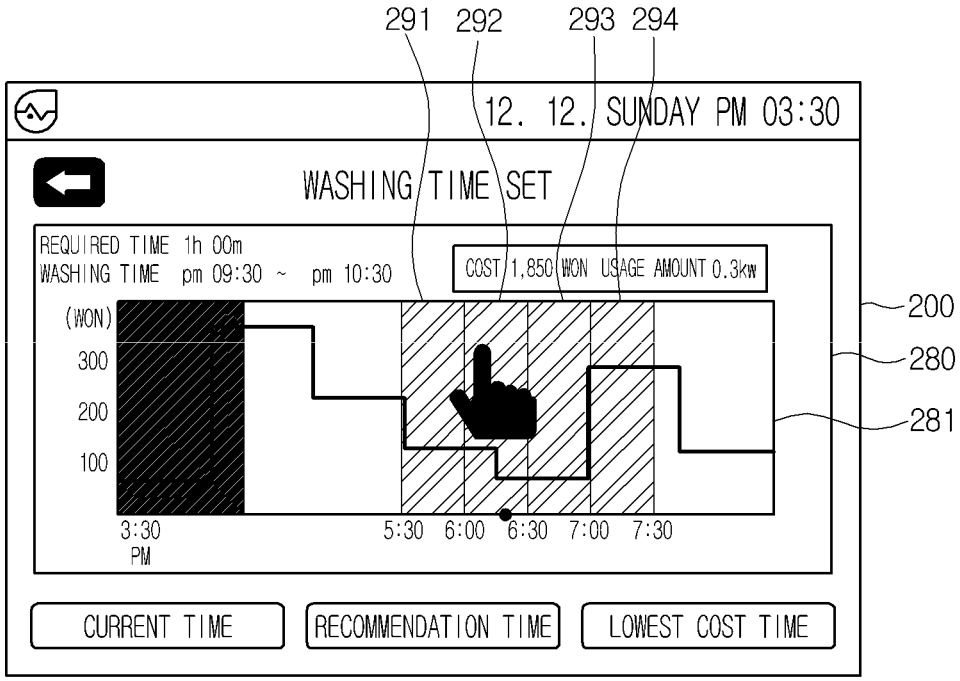
FIG. 19 is a view for explaining a process of changing a washing time according to a fourth embodiment.

FIG. 19 is a view for explaining a process of changing a washing time according to a fourth embodiment.

Referring to FIGS. 14 and 19, when a specific point on the graph of the power cost information screen 281 is selected on the screen of FIG. 14, a plurality of time periods may be displayed on the basis of a time corresponding to the selected point.

For example, the plurality of time periods (for example, four periods 291, 292, 293, and 294) may be divided by a first certain time (e.g., about 30 minutes). Also, a time period between an initial time and the last time of the plurality of time periods may be a second certain time (e.g., about two hours). Here, a time corresponding to the selected point may be included in the initial time period, the last time period, or an intermediate time period except for the initial and last time periods among the plurality of time periods. For example, when the selected point is about 6:10 P.M, a time period from about 5:30 P.M. to about 6:00 P.M. may be set to an initial period 291, a time period from about 6:00 P.M. to about 6:30 P.M. may be set to a first intermediate period 292, a time period from about 6:30 P.M. to about 7:00 P.M. may be set to a second intermediate period 293, and a time period from about 7:00 P.M. to about 7:30 P.M. may be set to the last period 294.

Also, when one period of the plurality of time periods is selected, the course performance time information 285 may be moved so that one of the washing start time and the washing end time of the course performance time information 285 may be included in the selected period. When the washing time is changed, the operation-related time information 282 and the operation-related power information 283 may be varied to correspond to the changed time.

Figure 20:
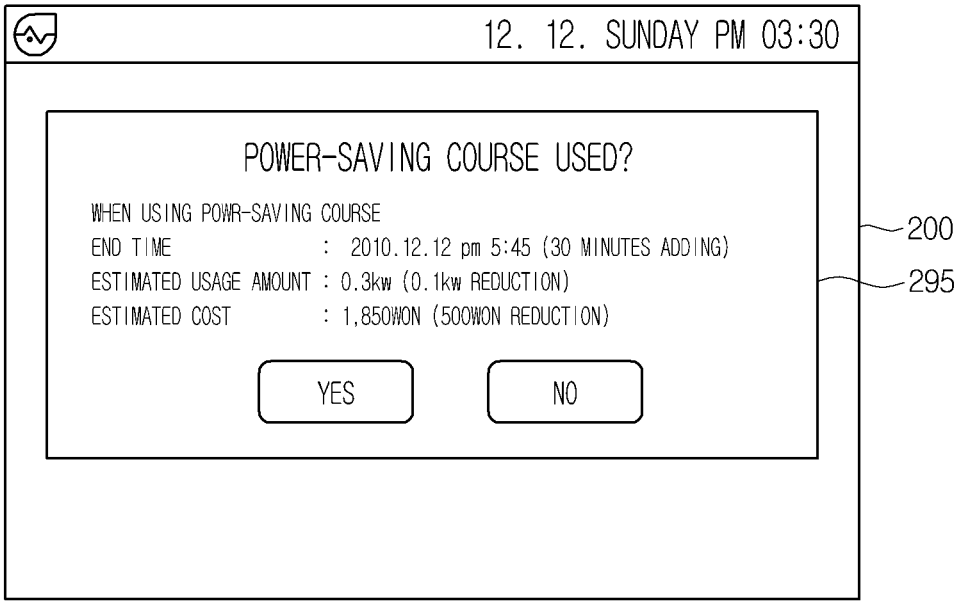
FIG. 20 is a view illustrating an example of a displayed screen when the start command is inputted on the screen of FIG. 14.

FIG. 20 is a view illustrating an example of a displayed screen when the start command is inputted on the screen of FIG. 14.

Referring to FIG. 20, when the start command is inputted on the screen of FIG. 14, in a case where power cost of the current time is expensive than mean power cost during a certain time from the current time, a power-saving course selection screen 295 may be displayed on the second screen 200. Here, for example, the certain time may be about 24 hours. The present disclosure is not limited to the certain time, and also, the certain time may be manually or automatically changed or set.

At least one of information of the changed washing end time and changed time content, an estimated power usage amount, a reduced power amount when compared that the course and time selected by the user are operated, estimated cost information, and reduced power cost when compared that the course and time selected by the user are operated may be displayed on the power-saving course selection screen 295.

In the current embodiment, the power-saving course may be a course in which an operation condition of the selected course is changed. For example, when the user selects a standard course and inputs an operation condition using the operation condition input part, the power-saving course may represent a course in which the selected operation condition is changed. For another example, the power-saving course may be one of plurality of courses except for the selected course.

The user may select whether the power-saving course is performed on the power-saving course selection screen. When the power-saving course is selected, the laundry handling apparatus 1 may perform the selected power-saving course. On the other hand, when the power-saving course is not selected, the screen of FIG. 20 may be switched into the previous screen or the washing machine may be operated on the basis of the information set by the user.

Figure 21:
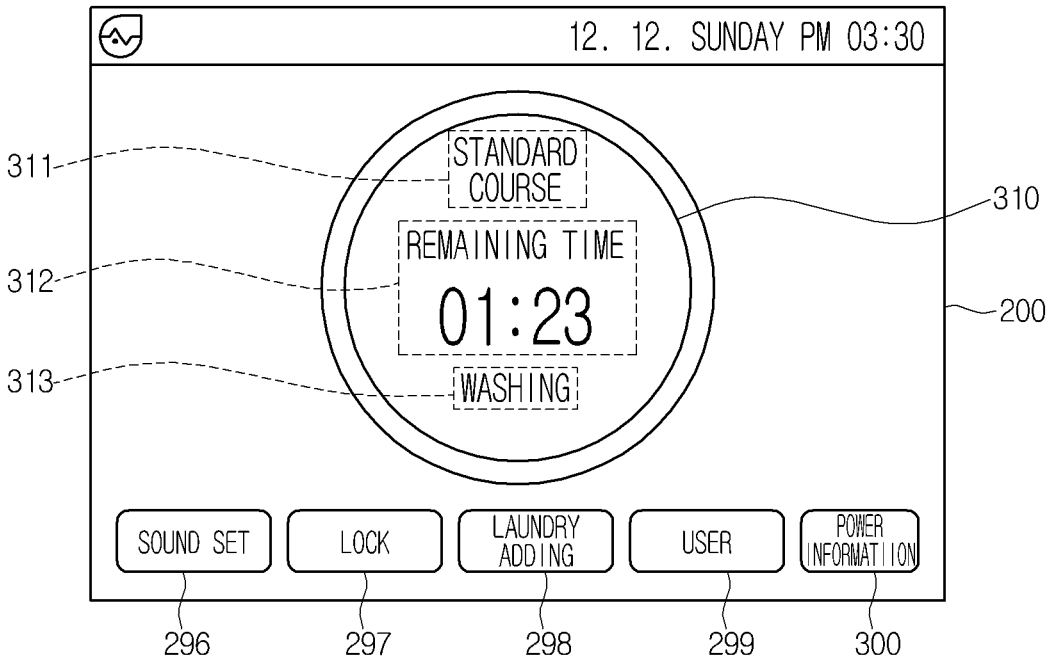
FIG. 21 is a view illustrating an example of a displayed screen when the start command is inputted in a state where the course and washing time are decided.

FIG. 21 is a view illustrating an example of a displayed screen when the start command is inputted in a state where the course and washing time are decided.

Referring to FIG. 21, when the start command is inputted in a state where the course and washing time are decided, information screen 310 related to an operation of the washing machine is displayed on the second screen 200.

A case in which the course and washing time are decided may be one of a case in which the current time is selected on one screen of the screens of FIGS. 14 to 19 and the start command is inputted, a case in which the recommendation time selection part 321 is selected on one screen of the screens of FIGS. 14 to 19 and the start command is inputted, a case in which the lowest cost selection part is selected on one screen of the screens of FIGS. 14 to 19 and the start command is inputted, a case in which the operation-related time is selected on one screen of the screens of FIGS. 16 to 19 and the start command is inputted, and a case in which the power-saving course is selected on the screen of FIG. 20.

At least one of selected course information 311, remaining time information 312, and the current status information 313 may be displayed on the operation-related information screen 310. For example, FIG. 21 illustrates a screen on which the selected course information 311, the remaining time information 312, and the current status information 313 are displayed on the operation-related information screen 310.

Here, the remaining time information 312 may be time information remaining from the current time until the washing process is completed. Here, the remaining time information 312 may be time information remaining from the current time until the washing process is completed even though the washing start time is after the current time. For example, when the current time is about 3:30 P.M., a washing required time is about 1 hour, and a washing start time is the current time, the remaining time information 312 may be about 1 hour. For another example, when the current time is about 3:30 P.M., a washing required time is about 1 hour, and a washing start time is about 4:30 P.M, the remaining time information 2 may be about 2 hour. On the other hand, when the washing start time is not the current time, predicted washing start time information may be displayed till the washing start time. Then, when the washing starts, the remaining time information 312 may be displayed.

The laundry handling apparatus 1 may perform at least washing, rinsing, and dehydration processes. The current status information 313 may be current progressing course information when the washing is progressed. On the other hand, when the washing process is on standby (when the washing start time is after the current time), the current status information 313 may be information for noticing on standby or reservation.

When the start command is inputted in the state where the course and washing time are decided, at least one of a sound set selection part 296, a locking selection part 297, a laundry adding selection part 298, a user storage selection part 299, and a power information selection part 300 may be additionally displayed on the second screen 200.

When the sound set selection part 296 is selected, sound generated from the laundry handling apparatus 1 may be set or changed in kind or intensity. When the locking selection part 297 is selected, a door may be locked.

Figure 22:
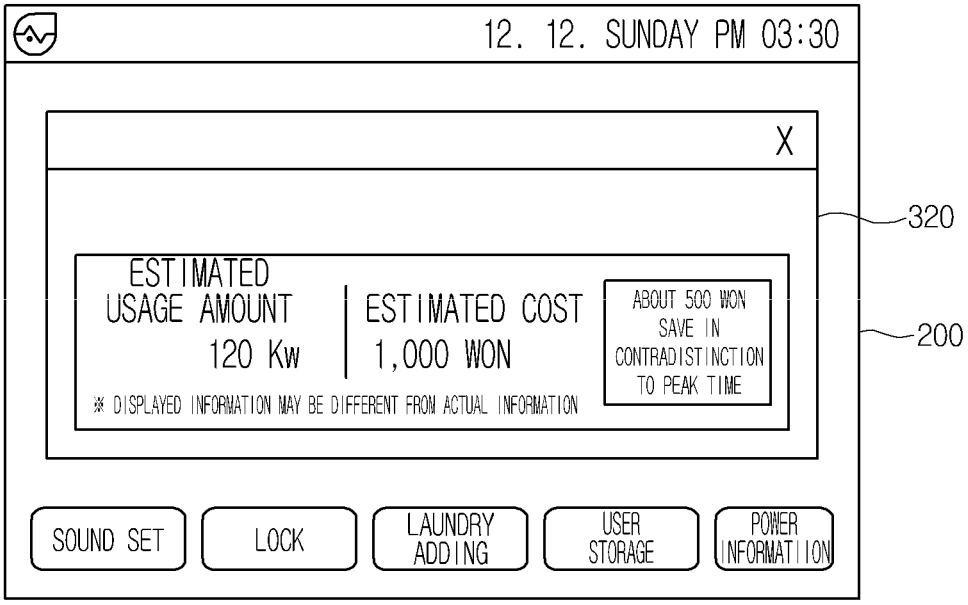
FIG. 22 is a view illustrating an example of a displayed screen when a power information selection part is selected on the screen of FIG. 21.

FIG. 22 is a view illustrating an example of a displayed screen when a power information selection part is selected on the screen of FIG. 21.

Referring to FIGS. 21 and 22, when the power information selection part 300 is selected on the screen of FIG. 21, a power information confirmation screen 320 may be displayed on the second screen 200. At least one of an estimated power usage amount, estimated power usage cost, saved cost when compared to that of a peak time (a time zone at which power cost is expensive) may be displayed on the power information confirmation screen 320. If the current time, at which the washing process is progressed, is a peak time and the power-saving course is not selected, saved cost may be about zero won.

According to the current embodiment, since the laundry handling apparatus 1 may communicate with the communication component, the laundry handling apparatus 1 may recognize the power cost.

As the laundry handling apparatus 1 recognizes the power cost, the power cost may be displayed on the display part.

Thus, the user may operate the laundry handling apparatus 1 in a time zone at which the power cost is inexpensive to reduce the power usage cost.

Also, as the laundry handling apparatus 1 recognizes the power cost, the power usage information may be displayed on the display part.

Figure 23:
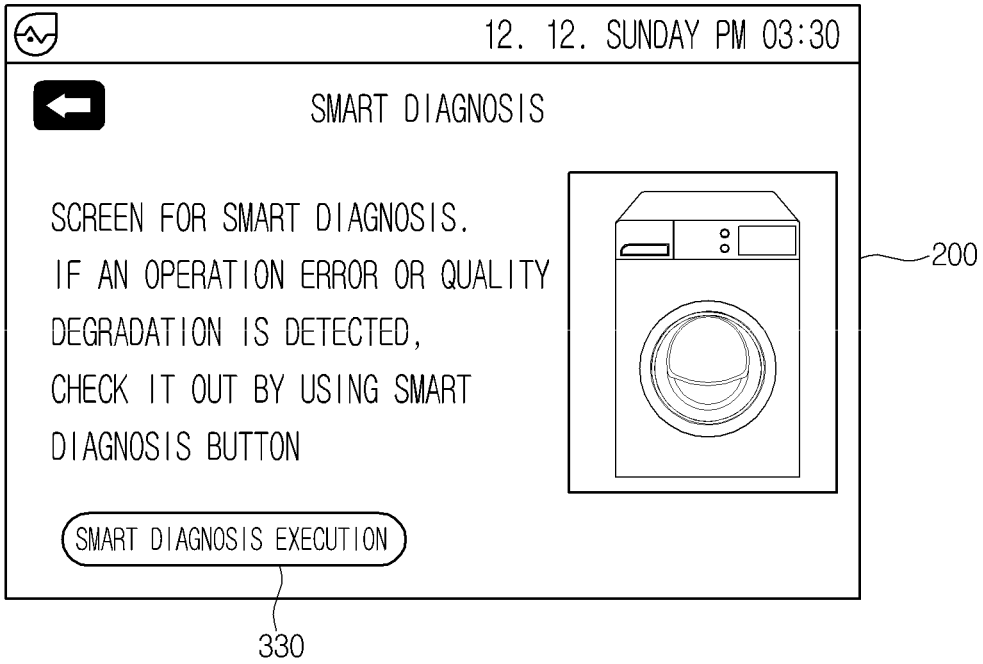
FIG. 23 is a view illustrating an example of a displayed screen when a smart diagnosis selection part is selected on the screen of FIG. 5.

FIG. 23 is a view illustrating an example of a displayed screen when a smart diagnosis selection part is selected on the screen of FIG. 5.

Referring to FIGS. 5 and 23, when the smart diagnosis selection part 412 is selected on the screen of FIG. 5, smart diagnosis information and a smart diagnosis execution selection part 330 are displayed on the second screen 200.

Figure 24:
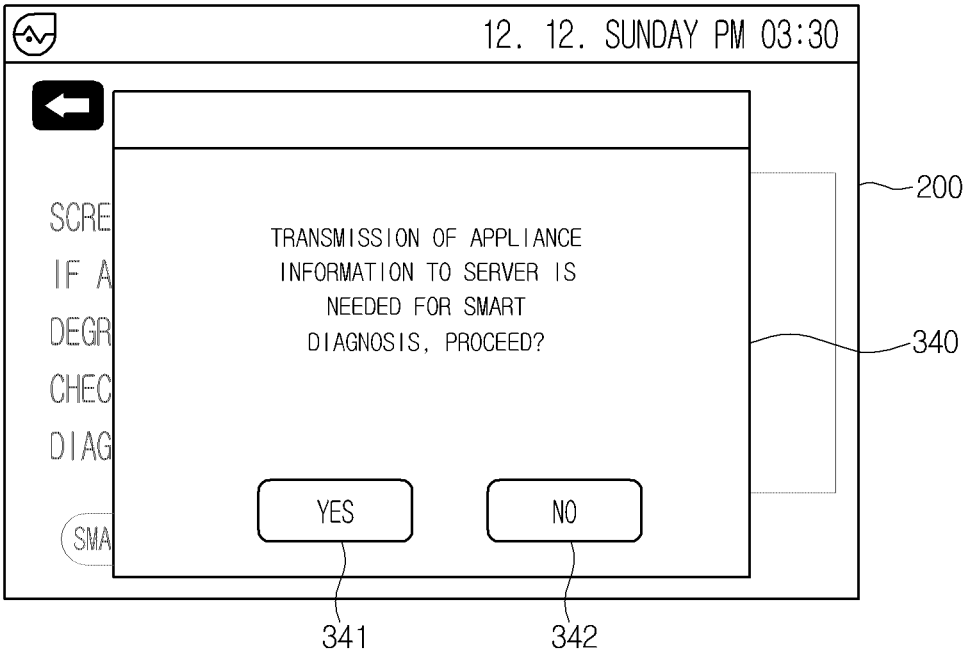
FIG. 24 is a view illustrating an example of a displayed screen when a smart diagnosis execution selection part is selected on the screen of FIG. 23.

FIG. 24 is a view illustrating an example of a displayed screen when a smart diagnosis execution selection part is selected on the screen of FIG. 23.

Referring to FIGS. 23 and 24, when the smart diagnosis execution selection part 330 is selected on the screen of FIG. 23, an information transmission confirmation screen 340 may be displayed. A first selection part 341 for selecting the information transmission and a second selection part 342 for canceling the information transmission may be displayed on the information transmission confirmation screen 340. When the second selection part 342 is selected, the current screen may return to the previous screen (the screen of FIG. 23) or the screen of FIG. 3.

Figure 25:
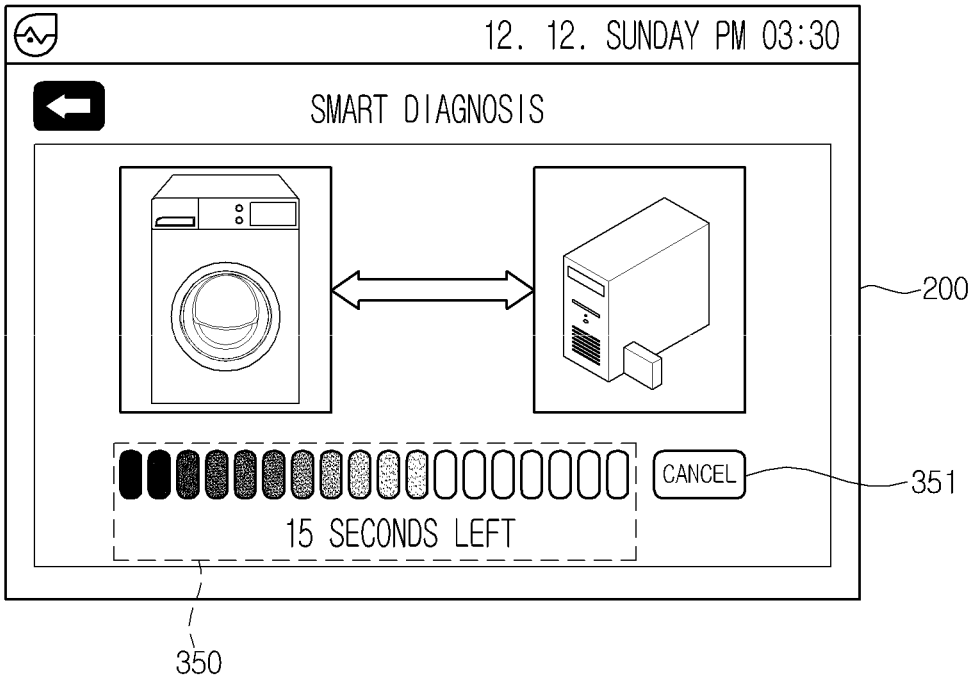
FIG. 25 is a view illustrating an example of a displayed screen when a selection part for transmitting information is selected in FIG. 24.

FIG. 25 is a view illustrating an example of a displayed screen when a selection part for transmitting information is selected in FIG. 24.

Referring to FIGS. 24 and 25, when the first selection part 341 is selected on the screen of FIG. 24, information transmission status information 350 and a cancel selection part 351 for canceling the information transmission during the information transmission process may be displayed on the second screen 200.

The information transmission status information 350 may include at least one of level information for displaying information transmission status by degrees, and information about time remaining until the transmission is completed.

When the first selection part 341 is selected on the screen of FIG. 24, status information of the laundry handling apparatus 1 may be transmitted to the above-described server. For another example, when the first selection part 341 is selected, status information of the laundry handling apparatus 1 may be transmitted to the above-described communication component. The diagnosis of the laundry handling apparatus 1 may be performed by the server or communication component.

Figure 26:
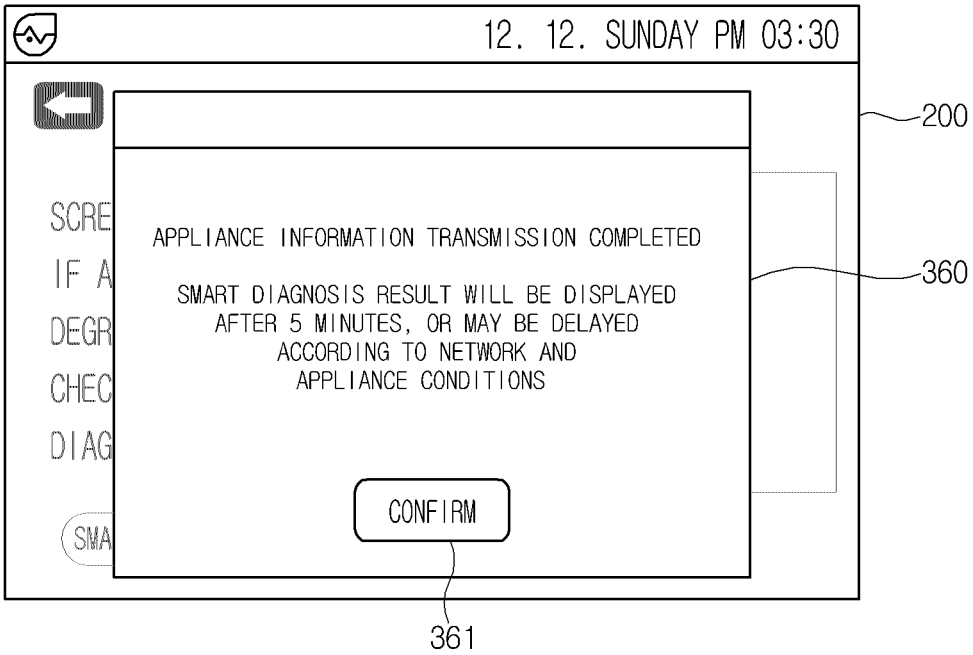
FIG. 26 is a view illustrating an example of a displayed screen when the information transmission is completed on the screen of FIG. 25.

FIG. 26 is a view illustrating an example of a displayed screen when the information transmission is completed on the screen of FIG. 25.

Referring to FIG. 26, when the information transmission is completed on the screen of FIG. 25, an information transmission completion screen 360 may be displayed on the second screen 200. Information about time required for confirming the diagnosed result may be displayed on the information transmission completion screen 360. Also, a confirmation selection part 361 may be displayed on the information transmission completion screen 360. When the confirmation selection part 361 is displayed, the screen of FIG. 26 may be switched into the screen of FIG. 3 or 5.

When the diagnosis is completed, diagnosis result information (not shown) may be displayed on the screen of FIG. 26.

Figure 27:
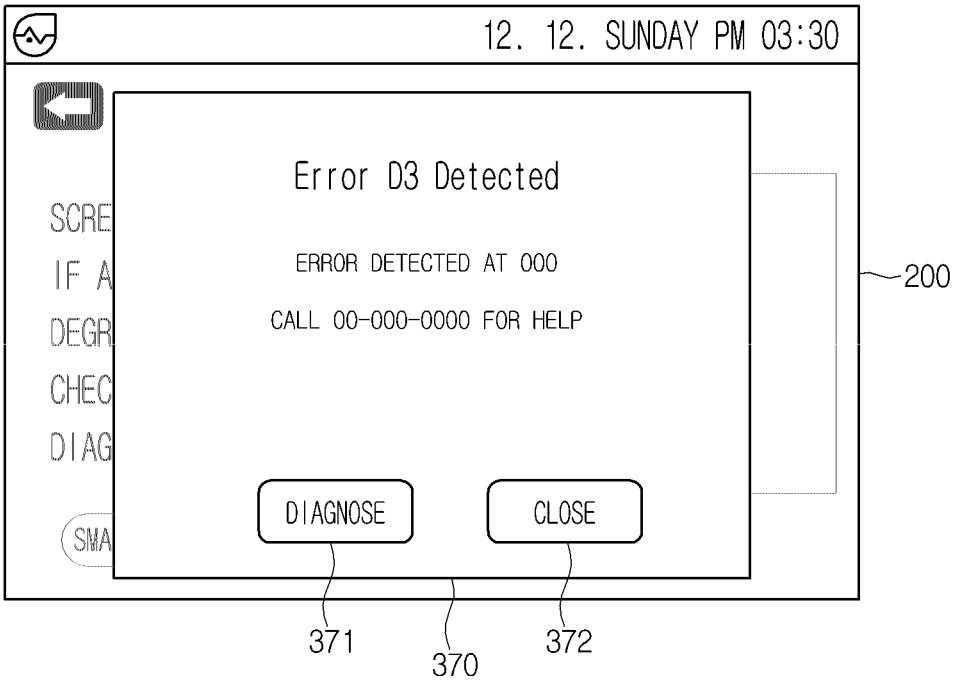
FIG. 27 is a view illustrating an example of a displayed screen when an abnormal state is recognized during an operation of the laundry handling apparatus.

FIG. 27 is a view illustrating an example of a displayed screen when an abnormal state is recognized during an operation of the laundry handling apparatus 1.

Referring to FIG. 27, when an error is detected during an operation of the laundry handling apparatus 1, an error notice screen 370 may be displayed on the second screen 200. Error information may be displayed on the error notice screen 370. Also, a smart diagnosis selection part 371 and a closure selection part 372 for closing the current screen may be displayed on the error notice screen 370. When the smart diagnosis selection part 371 is selected, the processes described with reference to FIGS. 24 to 26 will be performed, and the screens of FIGS. 24 to 26 may be displayed. When the closure selection part 372 is selected, the screen of FIG. 27 may be switched to, e.g., the screen of FIG. 21.

As such, an error of the laundry handling apparatus 1 may be diagnosed, and the diagnosed result may be displayed, and thus, the user may easily confirm the error of the laundry handling apparatus 1.

Figure 28:
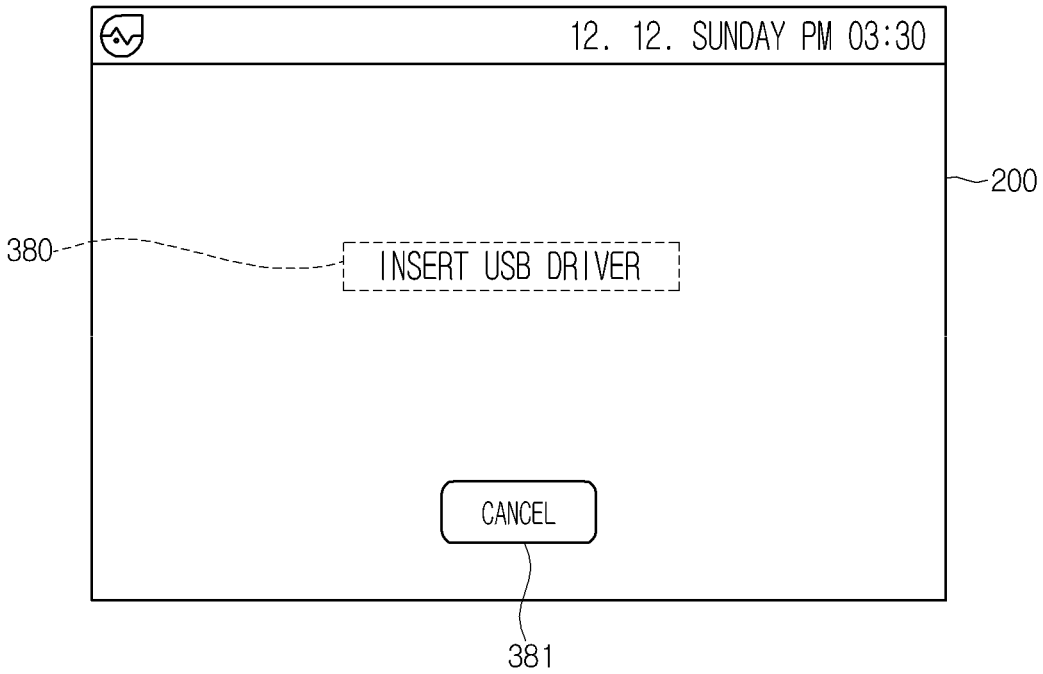
FIG. 28 is a view illustrating an example of a displayed screen when a software download selection part is selected on the screen of FIG. 5.

FIG. 28 is a view illustrating an example of a displayed screen when a software download selection part is selected on the screen of FIG. 5.

Referring to FIGS. 5 and 28, when the software download selection part 413 is selected on the screen of FIG. 5, request information 380 for requiring mounting of a universal serial bus (USB) driver (or an SD card) in which software to be downloaded is stored and a cancel selection part 381 for canceling the download of the software may be displayed on the second screen 200. When the cancel selection part 381 is selected, the screen of FIG. 28 may return to the screen of FIG. 3 or 5. Here, the laundry handling apparatus 1 includes a mounting part (not shown) for mounting the USB driver.

Figure 29:
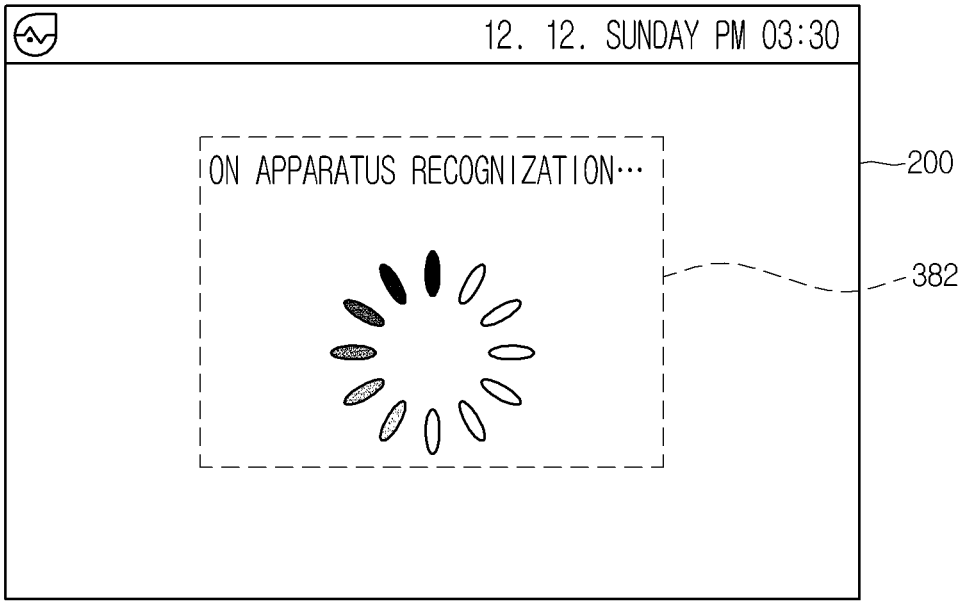
FIG. 29 is a view illustrating an example of a displayed screen of FIG. 28 when a universal serial bus (USB) driver is mounted.

FIG. 29 is a view illustrating an example of a displayed screen of FIG. 28 when the USB driver is mounted.

Referring to FIG. 29, when the USB driver is mounted, information 382 for noticing reorganizing of the USB driver may be displayed on the second screen 200. Here, even though the software download selection part 413 is not selected on the screen of FIG. 5 and the USB driver is mounted, the information for noticing recognizing of the USB driver may be displayed on the second screen 200.

Figure 30:
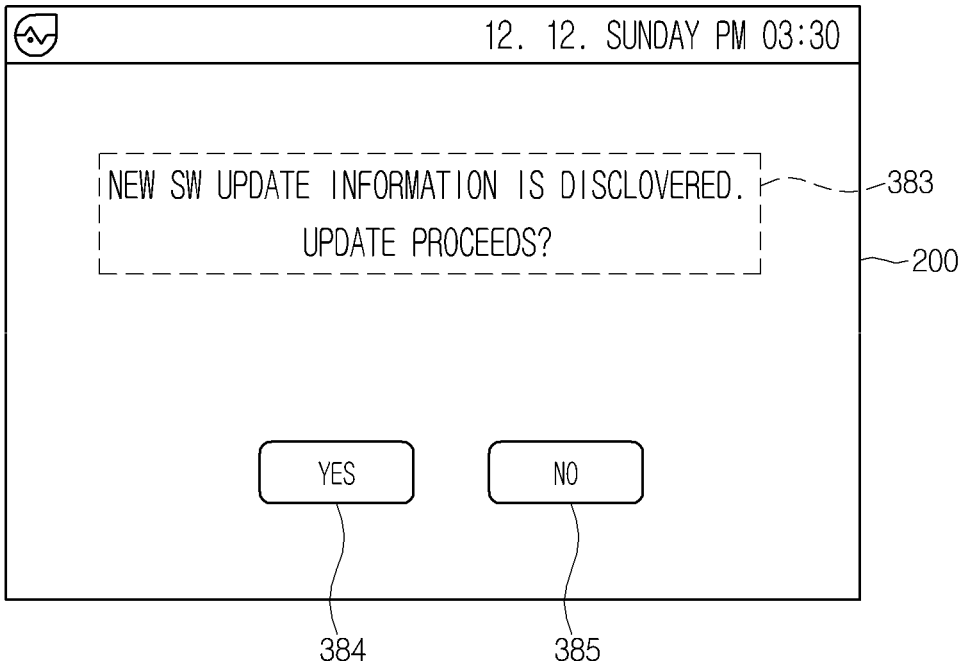
FIG. 30 is a view illustrating an example of a displayed screen when new update information is confirmed on the screen of FIG. 29.

FIG. 30 is a view illustrating an example of a displayed screen when new update information is confirmed on the screen of FIG. 29.

Referring to FIG. 30, when the USB driver is recognized and new update information are confirmed on the screen of FIG. 29, update confirmation information 383, a first selection part 384 for performing the update, and a second selection part 385 for canceling the update may be displayed on the screen of FIG. 29. When the second selection part 385 is selected, for example, the current screen may be switched into the screen of FIG. 3, 5, or 21.

Figure 31:
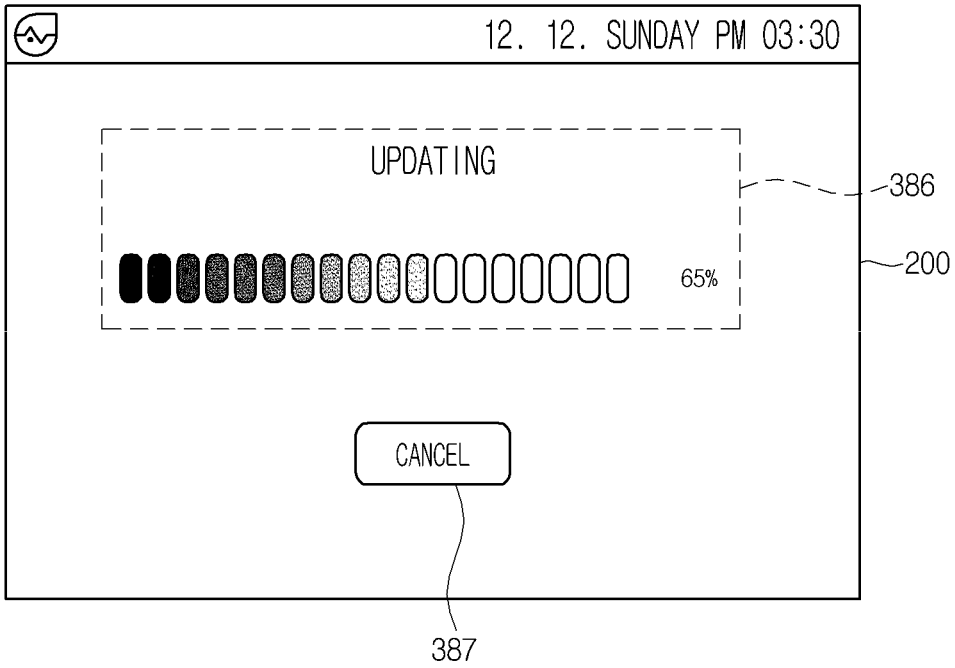
FIG. 31 is a view illustrating an example of a displayed screen during the updating.
Figure 32:
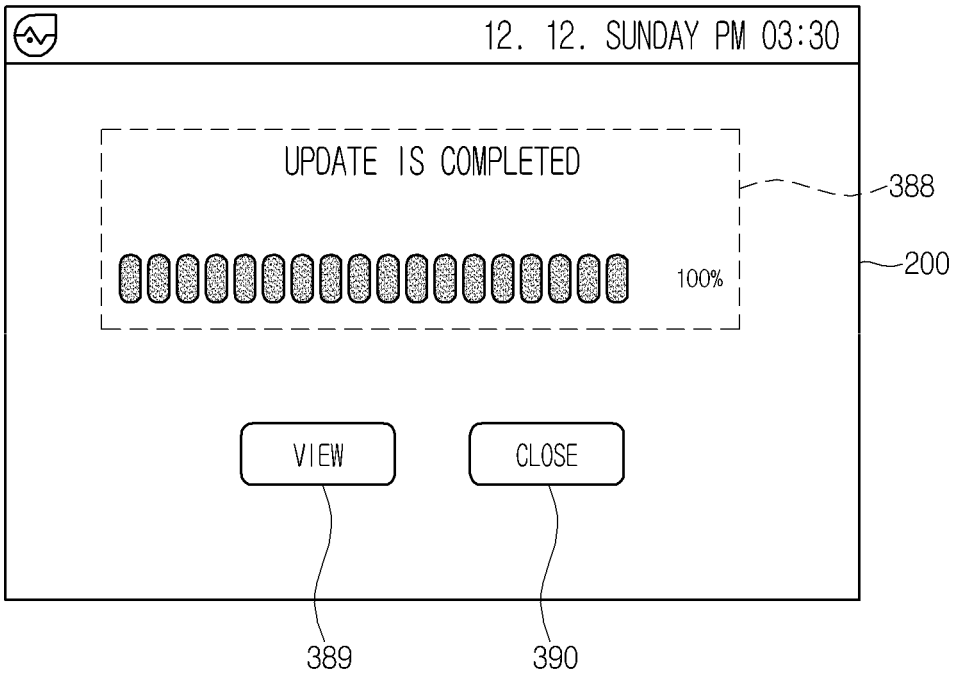
FIG. 32 is a view illustrating an example of a displayed screen when the updating is completed.

FIG. 31 is a view illustrating an example of a displayed screen during updating. FIG. 32 is a view illustrating an example of a displayed screen when the updating is completed.

Referring to FIG. 31, when the first selection part 384 is selected on the screen of FIG. 29, update progression status information 386 and a cancel selection part 387 for canceling the progression of the update may be displayed on the second screen 200. The update progression status information 386 may include at least one of level information for displaying the progression status of the update as a level and numeric information for displaying the progression status of the update as a percent. When the cancel selection part 387 is selected, the screen of FIG. 31 may be switched into the screen of FIG. 30.

Referring to FIG. 32, when the update progression is completed, completion information 388, a view selection part 389 for confirming the updated information, and a closure selection part 390 for closing the current displayed screen may be displayed on the second screen 200. When the closure selection part 390 is selected, for example, the current screen may be switched into the screen of FIG. 3. 5, or 21.

Figure 33:
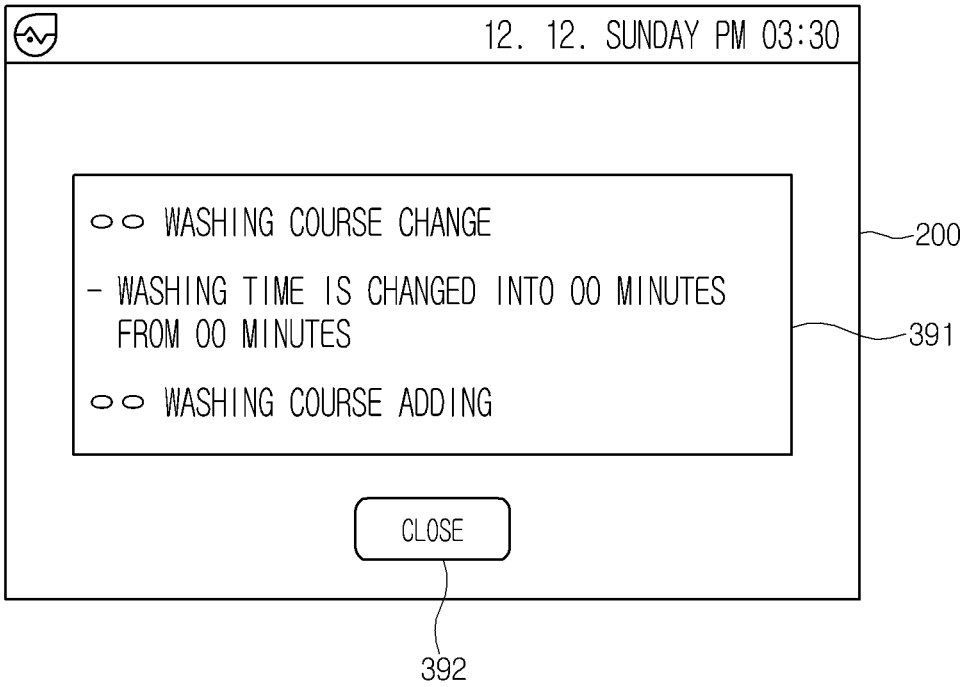
FIG. 33 is a view illustrating an example of a displayed screen when a selection part for confirming updated information is selected.

FIG. 33 is a view illustrating an example of a displayed screen when a selection part for confirming updated information is selected.

Referring to FIG. 33, when the view selection part 389 is selected on the screen of FIG. 32, updated detail information 391 and a closure selection part 392 for closing the current screen may be displayed. The software update according to the current embodiment may represent a case in which conditions of the course included in the current laundry handling apparatus 1 are changed or a new course is added. When the closure selection part 392 is selected, for example, the current screen may be switched into the screen of FIG. 3. 5, or 21.

According to the current embodiment, since new software may be updated, the additional course or the changed course may be utilized without replacing the laundry handling apparatus 1 with a new laundry handling apparatus.

Although the USB driver is mounted on the laundry handling apparatus 1 to update (or download) software in the current embodiment, new software may be transmitted from the communication component to the laundry handling apparatus 1 to update software.

Figure 34:
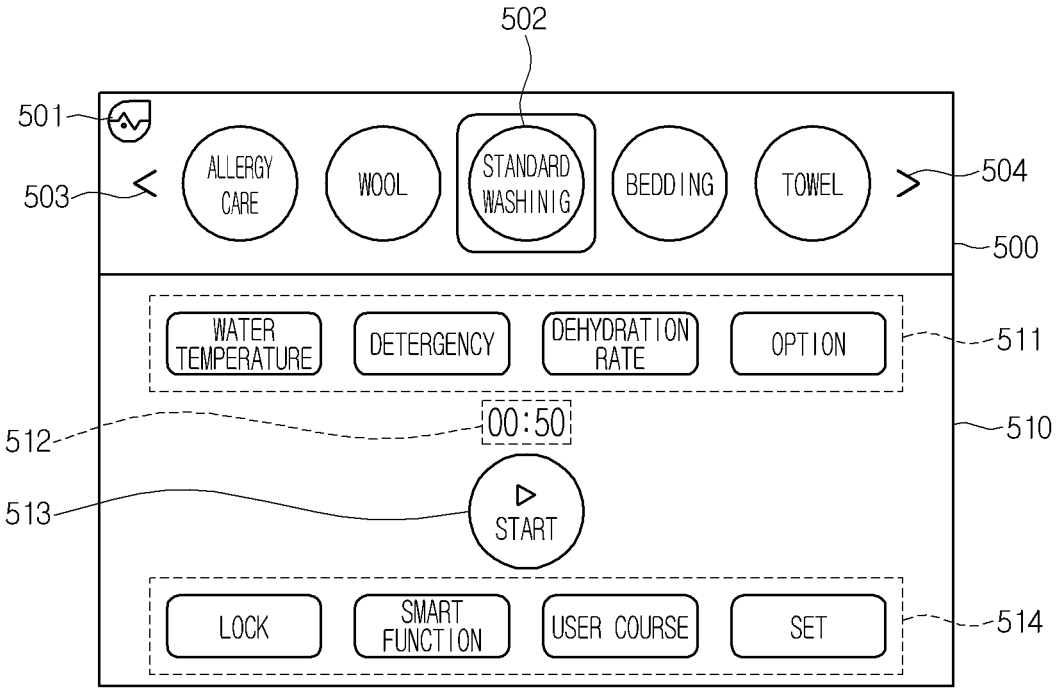
FIG. 34 is a view illustrating another example of the display part of the laundry handling apparatus of FIG. 3.

FIG. 34 is a view illustrating another example of the display part of the laundry handling apparatus of FIG. 3.

Referring to FIG. 34, a screen displayed on the display part 12 may include a first screen 500 and a second screen 510. For example, when the laundry handling apparatus 1 is turned on, the screen illustrated in FIG. 34 may be displayed. For example, the first screen 500 and the second screen 510 may be vertically or horizontally disposed with respect to each other. The first and second screens 500 and 510 may be screens independent apart from each other or screens divided according to displayed contents.

Smart grid on/off information 501 and a plurality of course selection parts 502 for selecting a course may be displayed on the first screen 500. When a portion of the whole course selection part 502 is displayed on the first screen 500, moving selection parts 503 and 504 may be further displayed.

A course function selection part 511, remaining time information 512, start selection part 513, and an additional function selection part 514 may be displayed on the second screen 510. The course function selection part 511 may include at least one of a water temperature selection part, a detergency selection part, a dehydration rate selection part, and an option selection part. The additional function selection part 514 may include at least one of a locking selection part, a smart function selection part, a user course selection part, a set selection part. When the smart function selection part is selected, the screen of FIG. 5 may be displayed.

Figure 35:
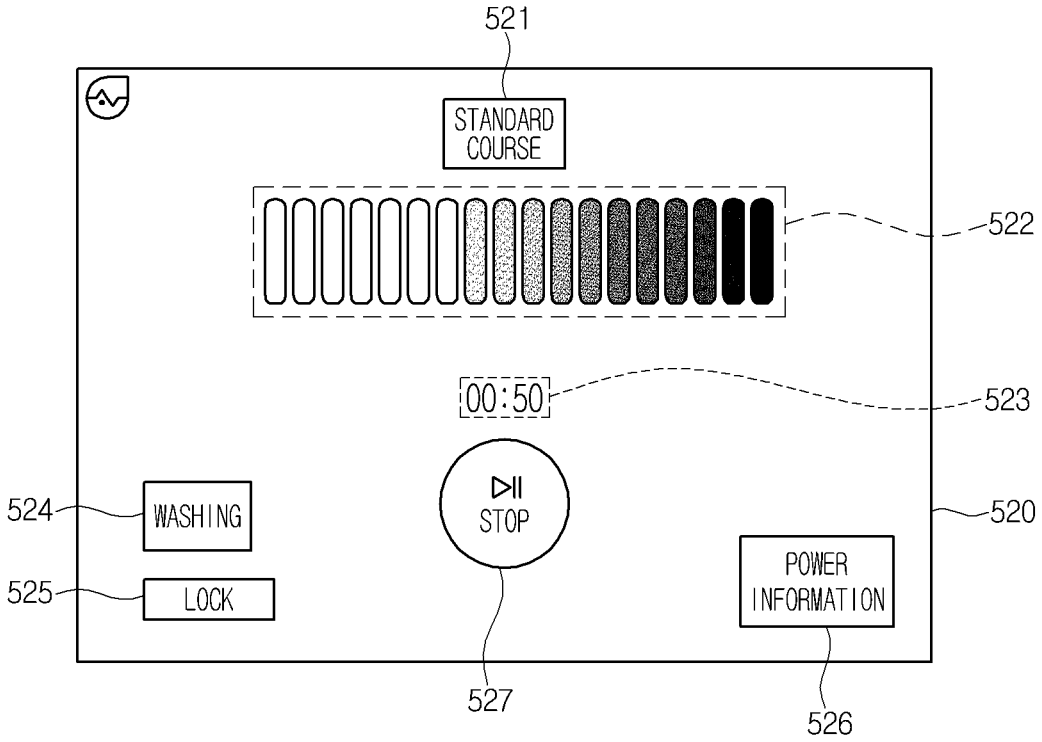
FIGS. 35 and 36 are views illustrating another example of the displayed screen when the start command is inputted in the state where the course and washing time of FIG. 21 are decided.
Figure 36:
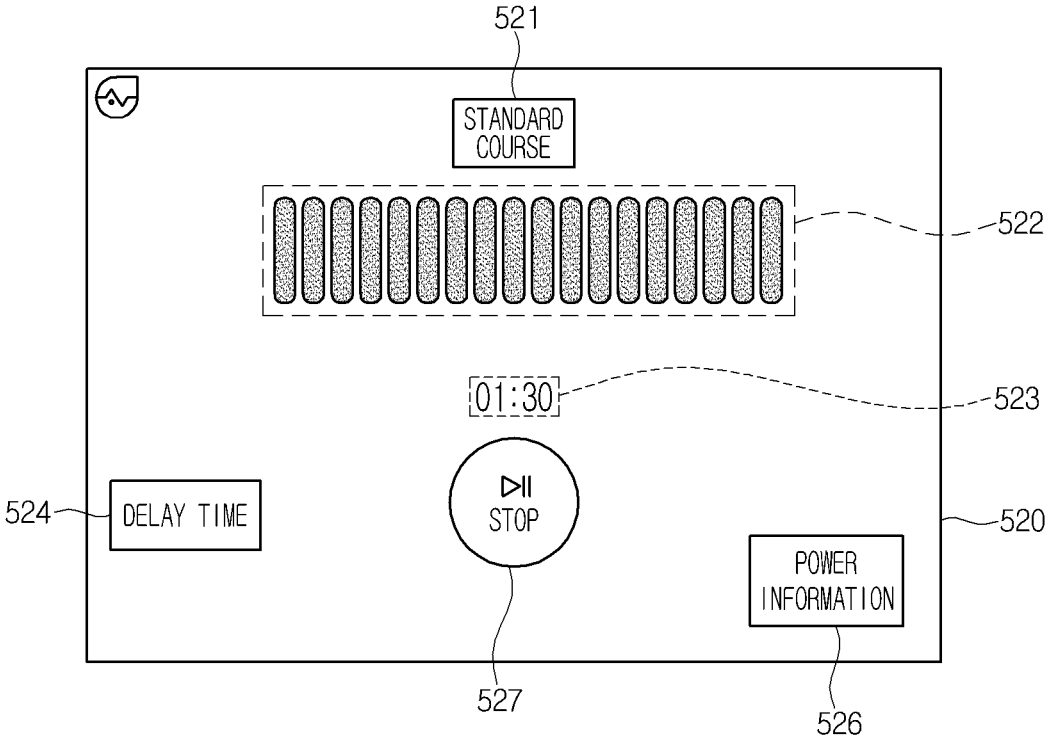

FIGS. 35 and 36 are views illustrating another example of the displayed screen when the start command is inputted in the state where the course and washing time of FIG. 21 are decided.

FIG. 35 illustrates a screen when the washing start time is the current time. FIG. 36 illustrates a screen when the washing start time is after the current time.

Referring to FIG. 35, when the start command is inputted in a state where the course and washing time are decided, operation-related information screen 520 may be displayed on the display part 12.

At least one of selected course information 521, remaining time information 522 and 523, and the current status information 524, a locking selection part 525, a power information selection part 526, and a stop/start selection part 527 may be displayed on the operation-related information screen 520.

The remaining time information 522 and 523 may include at least one of level information 522 for displaying a remaining time as a level and numeric information for displaying the remaining time as a numeral. The current state information 524 may be current progressing course information when the washing is progressed.

Referring to FIG. 36, when the washing start time is after the current time, the current status information 524 may be information for informing on standby or reservation. When the washing start time is a time after the current time, the locking selection part 525 may not be displayed on the operation-related information screen 520.

Figure 37:
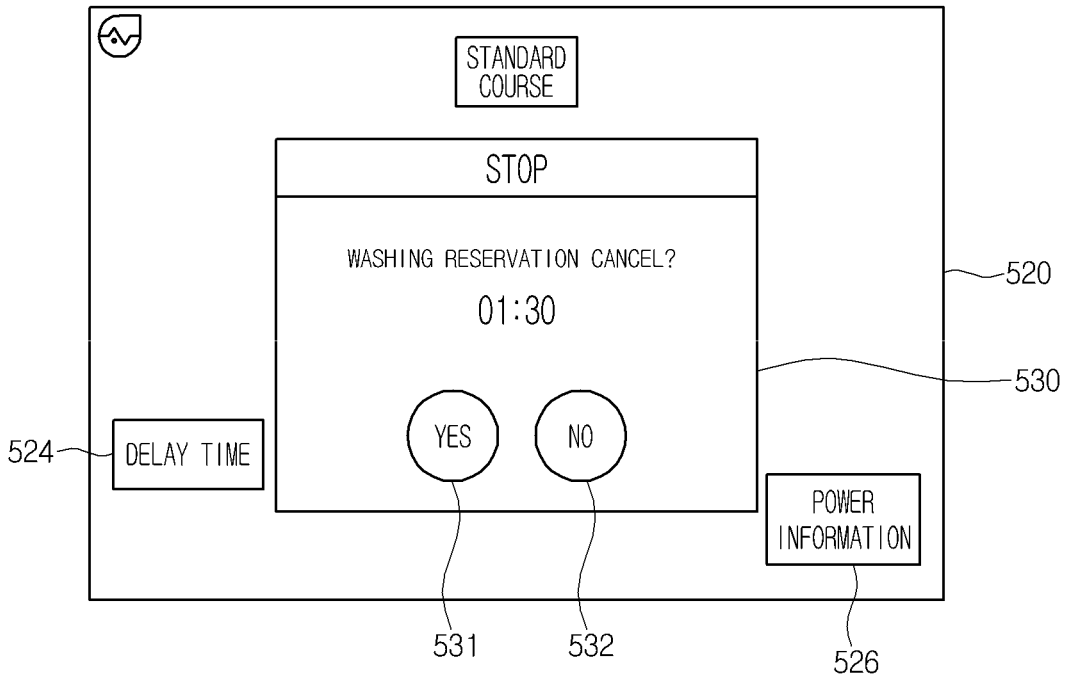
FIG. 37 is a view illustrating an example of a displayed screen when a stop/start selection part is selected on the screen of FIG. 36.

FIG. 37 is a view illustrating an example of a displayed screen when the stop/start selection part is selected on the screen of FIG. 36.

Referring to FIG. 37, when the stop/start selection part 527 is selected on the screen of FIG. 36, a reservation cancel confirmation screen 530 may be displayed on the operation-related information screen 520. A first selection part 531 for selecting the reservation cancel and a second selection part 532 for canceling the reservation cancel may be displayed on the reservation cancel confirmation screen 530. When the first selection part 531 is selected, for example, the screen of FIG. 37 may be switched into the screen of FIG. 34. When the second selection part 532 is selected, the screen of FIG. 37 may be switched into the screen of FIG. 36.

The displayed forms of the above described information are just examples, and thus, the present disclosure is not limited thereto.

Figure 38:
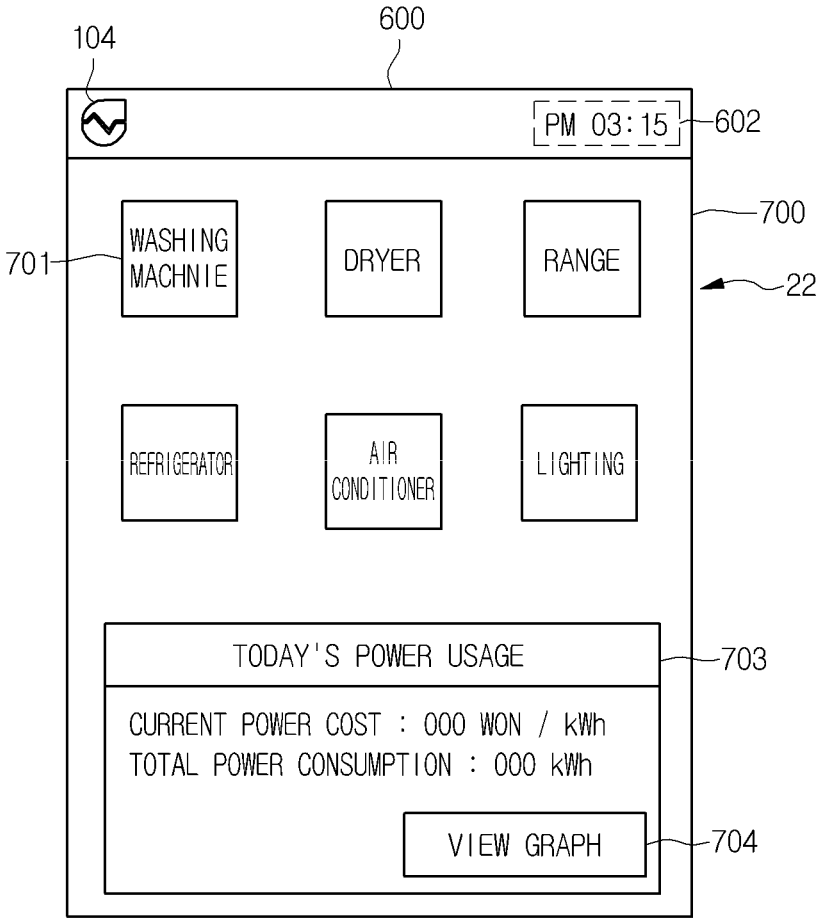
FIG. 38 is a view illustrating an example of a display part of a communication component according to an embodiment.

FIG. 38 is a view illustrating an example of a display part of a communication component according to an embodiment.

Referring to FIG. 38, a screen displayed on a display part 22 of the communication component 2 may include a first screen 600 and a second screen 700. The display part 22 of the communication component 2 may include a first user interface (UI) for remote control, and one or more second user interfaces (UIs) for performing other functions than the remote control. When the first user interface is activated, the screen of FIG. 38 may be displayed. In this case, the first user interface may be, e.g., an application for controlling a component.

For example, the first screen 600 and the second screen 700 may be vertically or horizontally disposed with respect to each other. The first and second screens 600 and 700 may be screens independent apart from each other or screens divided according to displayed contents.

Time information 602 and smart grid function on/off information 604 may be displayed on the first screen 600. Further, date information may be displayed on the first screen 600. The smart grid function on/off information 604 may be varied according to on/off states. For example, color, brightness, chroma, etc., of the displayed smart grid function information may be varied according to on/off states.

When the smart grid function is turned on, the communication component 2 may be operated based on energy information. The operation of the communication component 2 on the basis of the energy information may represent that the communication component 2 displays the energy information or transmits the energy information to the laundry handling apparatus 1.

At least one of power usage information and one or more component selection parts 701 for selecting a control target component may be displayed on the second screen 700. For example, as illustrated in FIG. 38, one or more of the component selection parts 701, and a power-related information screen 703 including power-related information may be displayed on the second screen 700.

The number of the component selection parts 701 displayed on the second screen 700 may be equal to the number of control target components registered in the communication component 2.

Current power cost information and total power consumption information may be displayed on the power-related information screen 703. A graph view selection part 704 (which may be referred to a detailed confirmation selection part) for additionally confirming detailed information may be displayed on the power-related information screen 703.

Figure 39:
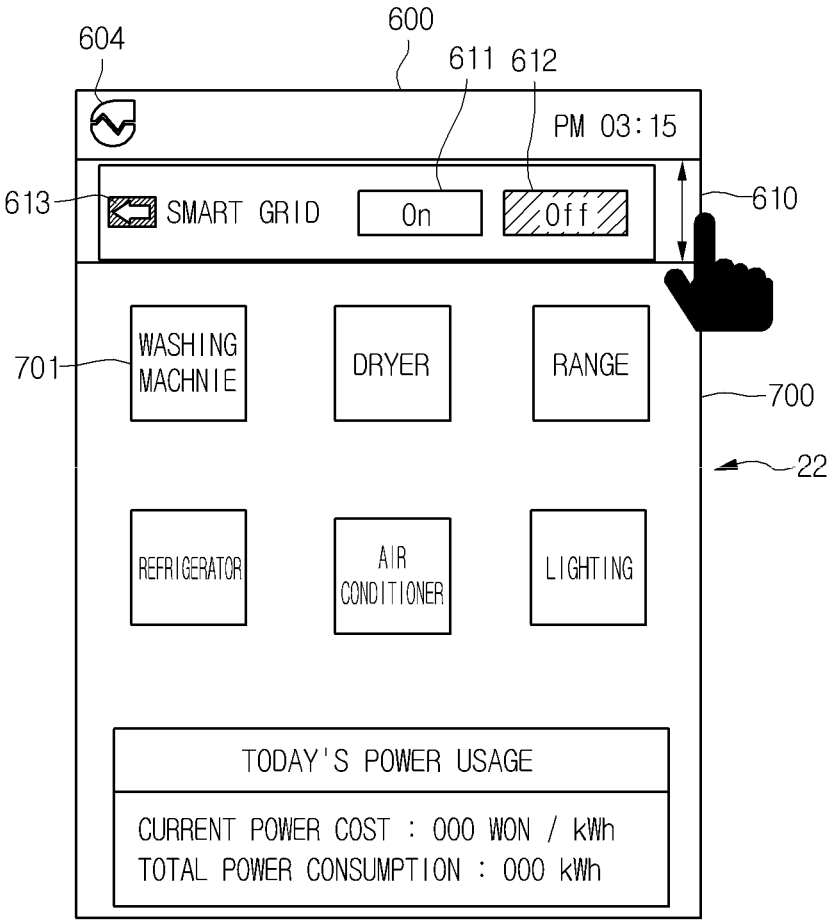
FIG. 39 is a view illustrating an example of a screen for selecting an on/off state of a smart grid function.

FIG. 39 is a view illustrating an example of a screen for selecting an on/off state of a smart grid function.

Referring to FIG. 39, when the boundary between the first and second screens 600 and 700 or the upper portion of the second screen 700 is touched and pulled down on the screen of FIG. 38, a smart grid information screen 610 may be displayed. An on selection part 611 and an off selection part 612 may be displayed on the smart grid information screen 610. When the on selection part 611 is selected, the smart grid function is turned on. Also, when the off selection part 612 is selected, the smart grid function is turned off.

On the other hand, a single selection part may be displayed on the smart grid information screen 610. Thus, the smart grid function may be turned on or off according to the pushed number of selection part. A previous selection part 613 for moving the current screen into the previous screen (see the screen of FIG. 38) may be additionally displayed on the smart grid information screen 610. When the previous screen selection part 613 is selected, the smart grid information screen 610 disappears. Also, when the smart grid information screen 610 is moved upward while touching the smart grid information screen 610, the smart grid information screen 610 may disappear. For another example, when the smart grid information 604 is selected on the screen of FIG. 39, a pop up screen including the on selection part and the off selection part or a pop up screen the single selection part may be displayed.

The smart grid information screen 610 may be a portion of the second screen 700 or a screen separated from the second screen 700.

Figure 40:
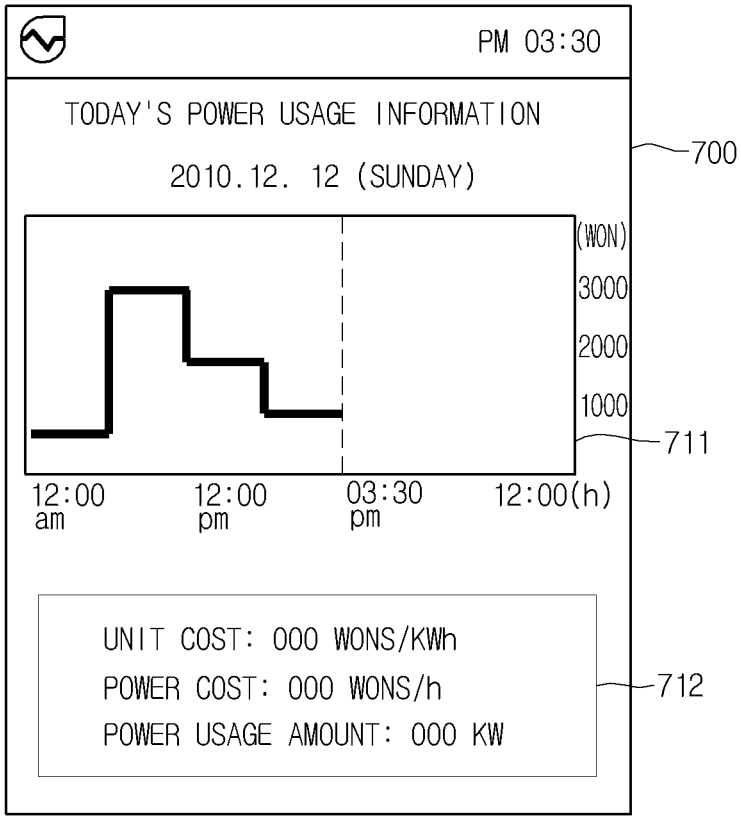
FIG. 40 is a view illustrating an example of a displayed screen when a graph sight selection part is selected on the screen of FIG. 38.

FIG. 40 is a view illustrating an example of a displayed screen when a graph sight selection part is selected on the screen of FIG. 38.

Referring to FIGS. 38 and 40, when the smart grid function is in the on state and the graph view selection part 704 is selected on the screen of FIG. 2, power information screens 711 and 712 may be displayed on the second screen 700. The power information screens 711 and 712 may include at least one of a graph information screen 711 and a text information screen 712. Hourly power usage cost graph information (or power usage amount graph information) of today may be displayed on the graph information screen 711. For example, power usage cost graph information ranging from 12 A.M. to the present time may be displayed on the graph information screen 711. For example, when the current time is 3:30 P.M., usage amount graph information ranging from 12 A.M. to 3 P.M. may be displayed. At least one of unit power cost information, power usage cost information, and power usage amount information may be displayed on the text information screen 712.

The power information screens 711 and 712 may be displayed for a certain time on the second screen 700, and then, be switched into the screen of FIG. 38. For another example, when a previous screen selection part (not shown) is selected, the screen of FIG. 40 may be switched into the screen of FIG. 38.

Figure 41:
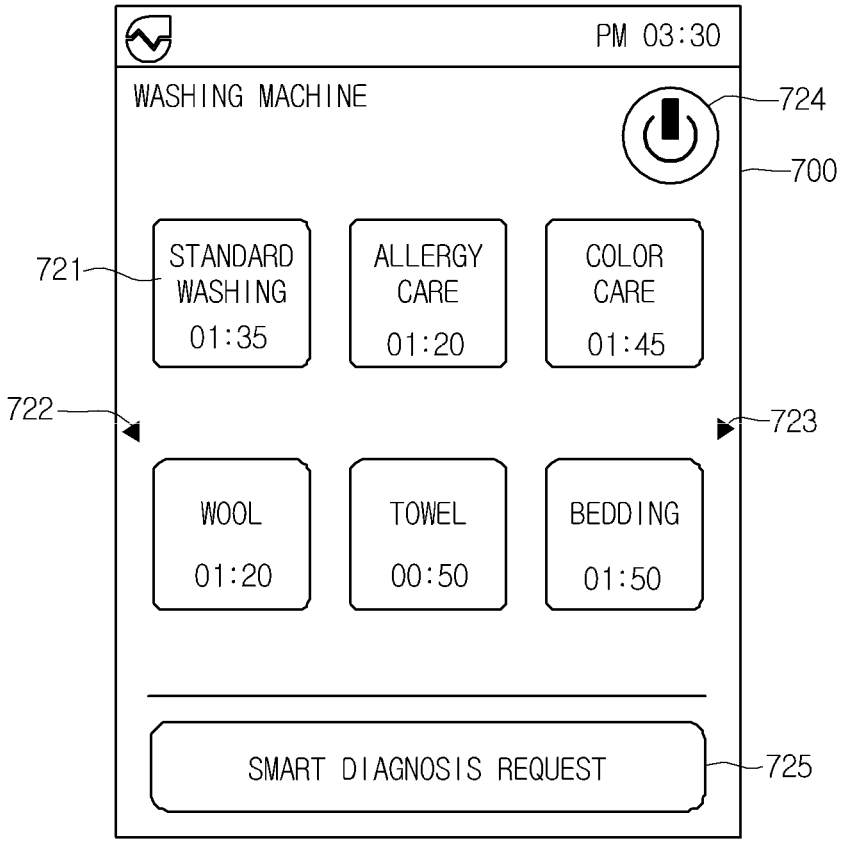
FIG. 41 is a view illustrating an example of a displayed screen when a specific component selection part is selected on the screen of FIG. 38.

FIG. 41 is a view illustrating an example of a displayed screen when a specific component selection part is selected on the screen of FIG. 38. For example, in FIG. 41, a washing machine is selected as one kind of the laundry handling apparatus 1.

Referring to FIGS. 38 and 41, when a specific component selection part (e.g., a washing machine selection part) is selected on the screen of FIG. 38, at least one course selection part 721 for selecting a course and an on/off selection part 724 for selecting on/off states of the washing machine may be displayed on the second screen 700. The washing machine may be turned on or off according to the pushed number of the on/off selection part 724. For example, color, brightness, chroma, etc., of the on/off selection part 724 may be varied according to on/off states of the washing machine. A smart diagnosis request selection part 725 may be additionally displayed on the second screen 700.

A plurality of performable course selection parts 721 may be displayed on the second screen 700. Here, the whole course selection parts 721 may be displayed on the second screen 700, or a portion of the plurality of course selection parts 721 may be displayed on the second screen 700. A user may select one of the plurality of course selection parts 721 displayed on the second screen 700. When a portion of the plurality of course selection parts 721 is displayed on the second screen 700, course moving parts 722 and 723 for confirming non-displayed course selection parts may be additionally displayed.

Figure 42:
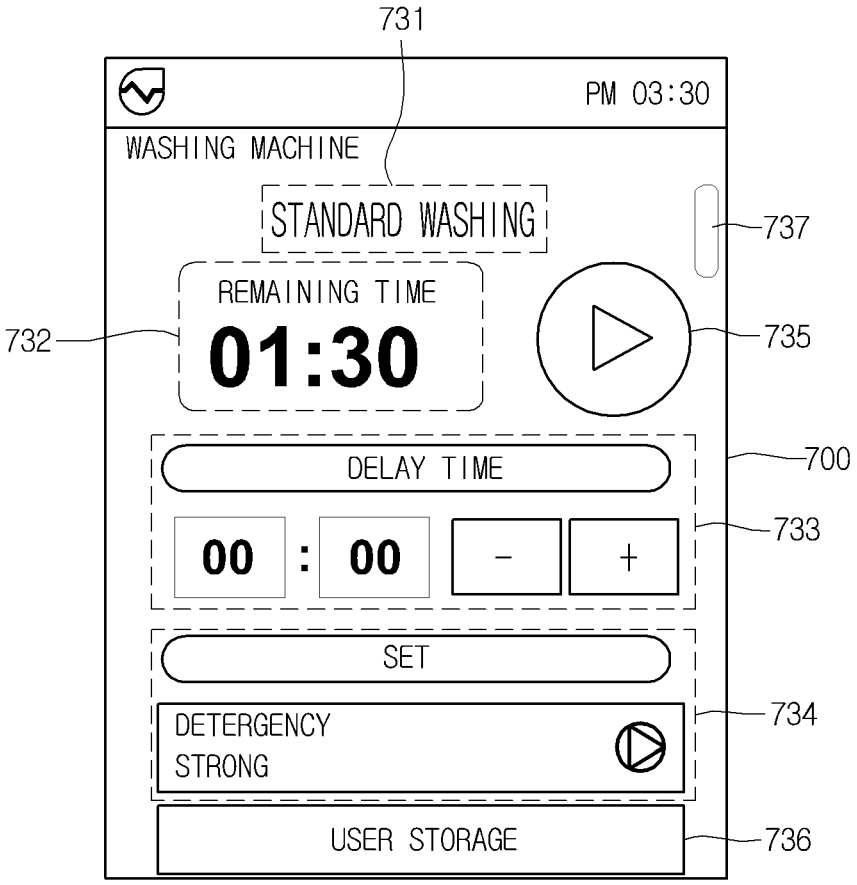
FIG. 42 is a view illustrating an example of a displayed screen when a specific course is selected on the screen of FIG. 41.

FIG. 42 is a view illustrating an example of a displayed screen when a specific course is selected on the screen of FIG. 41.

Referring to FIGS. 41 and 42, when a specific course selection part 721 (e.g., a standard course selection part) is selected on the screen FIG. 41, at least one of selected course information 731, time information 732 remaining until the course performance is completed, a delay time set part 733 for setting a delay time, an operation condition input part 734, a start selection part 735, and a user storage selection part 736 may be displayed on the second screen 700.

The delay time may represent a time at which a specific course selected at a time point after the current time. That is, the delay time may be delay start information. The delay time may be changed according to the selection of the delay time set part 733.

The operation condition input part 734 may include at least one of a detergency selection part, a water temperature selection part, and a dehydration rate selection part. When the detergency selection part, the water temperature selection part, and the dehydration rate selection part are provided at the same time, a portion or all of the detergency selection part, the water temperature selection part, and the dehydration rate selection part may be displayed on the second screen 700. When a portion of the detergency selection part, the water temperature selection part, and the dehydration rate selection part is displayed on the second screen 700, a scroll bar 737 for confirming non-displayed selection parts may be further displayed on the second screen 700.

The operation conditions which can be selected through the operation condition input part 734 may be previously set for specific courses. That is, when a specific course (e.g., a standard course) is selected on the screen of FIG. 41, the selected course information 731 and the operation condition input part 734 may be displayed on the second screen 700 and the conditions previously set for specific courses may be displayed on the operation condition input part 734. The user may change the operation conditions of the specific courses using the operation condition input part 734. Here, when the user storage 736 is selected in a state where the user inputs an operation condition of a specific course using the operation condition input part 734, the inputted operation condition is recognized as a separate user course to store the operation condition in the memory part (see reference numeral 23 of FIG. 1). That is, the user course may be added to an existing course stored in the memory part (see reference numeral 23 of FIG. 1). When the user course is added, the added user course may be displayed on the screen 201 of FIG. 41 and the user may select the displayed user course.

Figure 43:
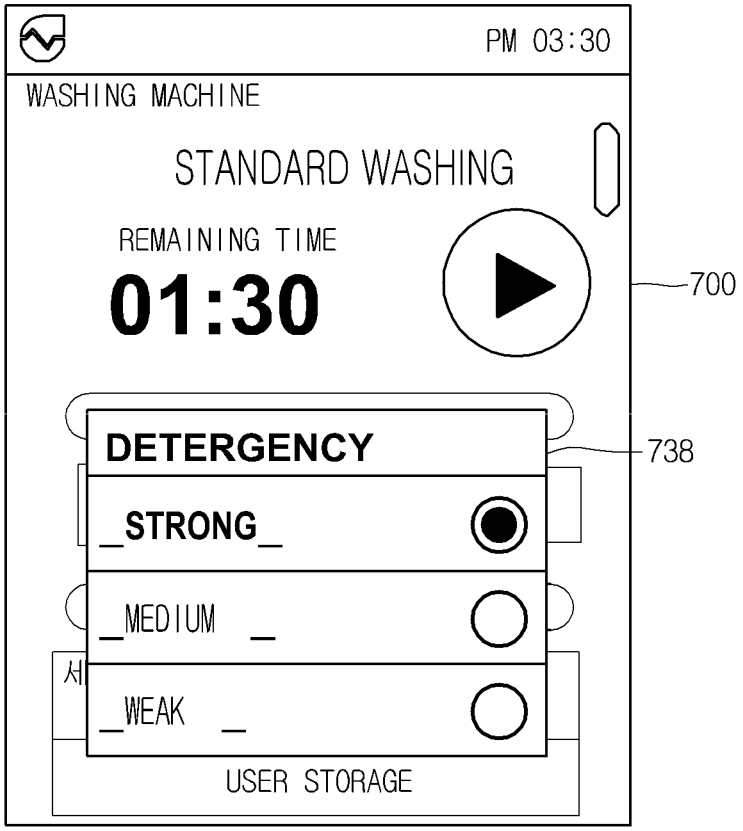
FIG. 43 is a view illustrating an example of a displayed screen when an operation condition input part is selected on the screen of FIG. 42.

FIG. 43 is a view illustrating an example of a displayed screen when an operation condition input part is selected on the screen of FIG. 42.

Referring to FIGS. 42 and 43, when one of one ore more selection parts constituting the operation condition input part 734 is selected, a detailed condition input part 738 may be displayed. For example, when the detergency selection part is selected, one of strong, medium, weak modes may be selected.

Figure 44:
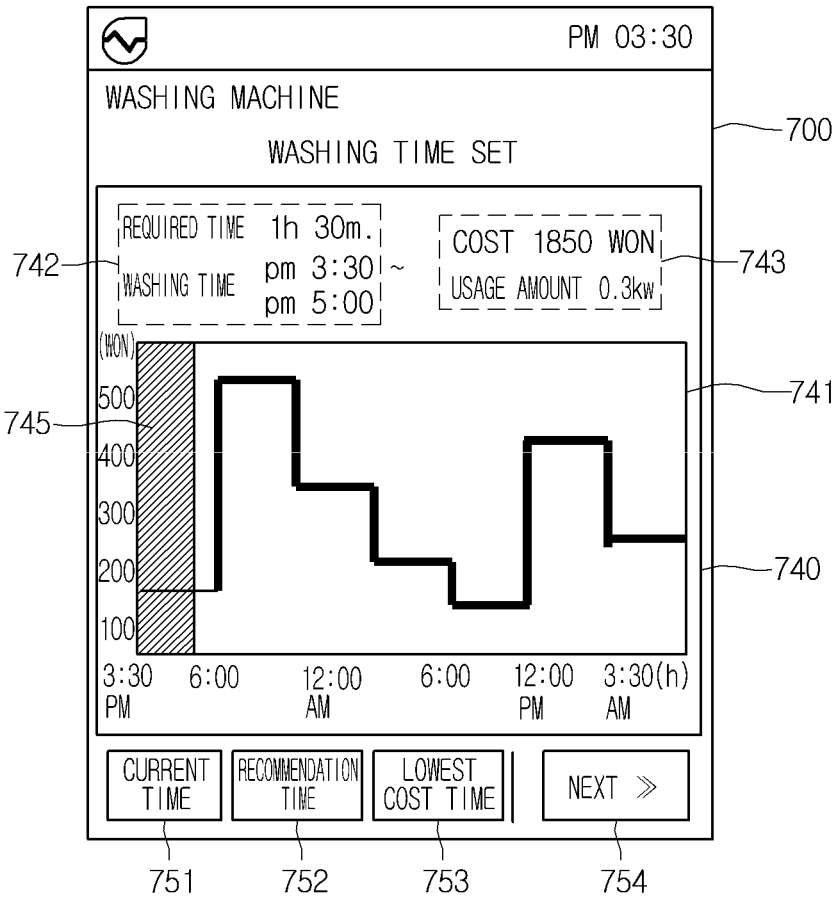
FIG. 44 is a view illustrating an example of a displayed screen when a start selection part is selected in a state where the screen of FIG. 42 is displayed.

FIG. 44 is a view illustrating an example of a displayed screen when the start selection part is selected in a state where the screen of FIG. 42 is displayed.

Referring to FIGS. 42 and 44, when the start selection part 735 is selected on the screen of FIG. 42, a washing time set screen 740 may be displayed on the second screen 700.

At least one of a power cost information screen 741, operation-related time information 742, and operation-related power information 743 may be disposed on the washing time set screen 740. FIG. 44 illustrates a screen on which the power cost information screen 741, the operation-related time information 742, and the operation-related power information 743 are displayed on the washing time set screen 740.

The current time selection part 751 and at least one recommendation selection parts may be disposed on the second screen 700. The at least one recommendation selection part may include a recommendation time selection part 752 (which may be referred to as a first recommendation selection part), the lowest cost time selection part 753 (which may be referred to a second commendation selection part), and the next selection part 754 for switching the current screen into the next screen.

In detail, the operation-related time information 742 may include at least one of course performance time information, washing start time information, and washing end time information. The operation-related power information 743 may include at least one of power usage cost information and power usage amount information when a corresponding course is performed.

The power cost information screen 741 may include power cost-related graph information (e.g., a line graph) and course performance time information 745. The power cost-related graph information may be hourly cost graph information. In the power cost information screen 741, a horizontal axis may represent a time, and a vertical axis may represent cost. Also, an initial time (a reference time) on the horizontal axis may be the current time, and a final time may be a time after 24 hours from the current time. That is, a time range may be about 24 hours in the power cost information screen 741. Also, the power cost information screen 741 may include power cost information during the 24 hours. In the current embodiment, the time range may be manually or automatically changed or set. Thus, the present disclosure is not limited to the time range. An initial time may be disposed at a left side on the screen on which the power cost information screen 741, and the last time may be disposed at a right side. Alternatively, the initial time may be disposed on the right side of the power cost information screen 741, and the last time may be disposed on the left side.

When the start selection part 735 is inputted on the screen of FIG. 42 in a state where the delay time is set, the course performance time information 745 may be disposed at a position corresponding to the delay time on the power cost information screen 741. For example, when the current time is about 3:30 P.M. and the user inputs 6 hours as the delay time, a washing start time delayed during the course performance time information 745 may be disposed to correspond to about 9:30 P.M., and a delayed washing end time may be disposed to correspond to about 10:30 P.M. Here, the operation-related time information 742 and the operation-related power information 743 may be varied to correspond to the position (delay time) of the course performance time information 745.

When the commendation time selection part 752 is selected on the screen of FIG. 44, the course performance time information 745 may be moved to a time at which power cost is the lowest within a range from the current time to a first reference time. Here, the first reference time may be about 4 hours. For example, in a case where the current time is about 3:30 P.M., the commendation time selection part 752 is selected, the course performance time information 745 may be moved to a time at which power cost is the lowest within a range from the current time to about 7:30 P.M. If the power cost is the lowest at the current time, the course performance time information 745 is not moved.

When the lowest cost time selection part 753 is selected on the screen of FIG. 44, the course performance time information 745 may be moved to a time at which power cost is the lowest within a range from the current time to a second reference time. Here, the second reference time may be about 24 hours. For example, in a case where the current time is about 3:30 P.M., the commendation time selection part 753 is selected, the course performance time information 745 may be moved to a time zone in which power cost is the lowest within a range from the current time to about 3:30 P.M. If the power cost is the lowest at the current time, the course performance time information 745 is not moved.

Figure 45:
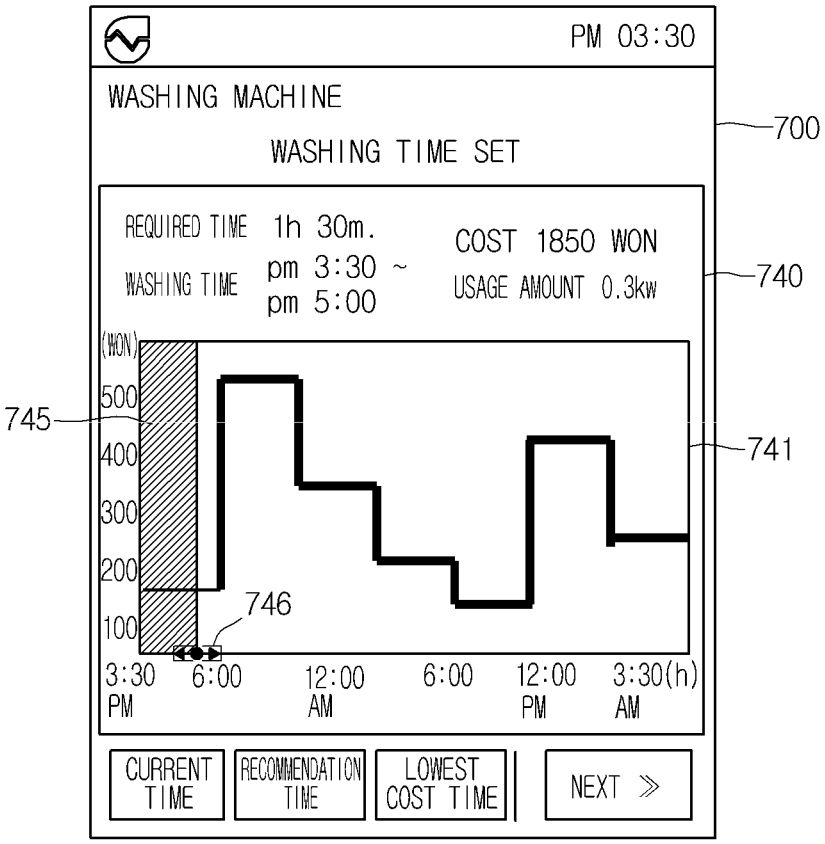
FIG. 45 is a view for explaining a process of changing a washing time according to an embodiment.

FIG. 45 is a view for explaining a process of changing a washing time according to an embodiment.

Referring to FIG. 45, when the washing start time (a left portion of the course performance time information) or the washing end time (a right portion of the course performance time information) are selected from the course performance time information 745, a washing time change part 746 is displayed. For example, although the washing time change part 746 for changing the washing end time is displayed in FIG. 45, when the washing start time is selected, the washing time change part 746 for changing the washing start time may be displayed. Also, the washing start time or the washing end time may be changed by a certain time unit using the washing time change part 746. When the washing time is changed, the operation-related time information 782 and the operation-related power information 783 may be varied to correspond to the changed time.

Figure 46:
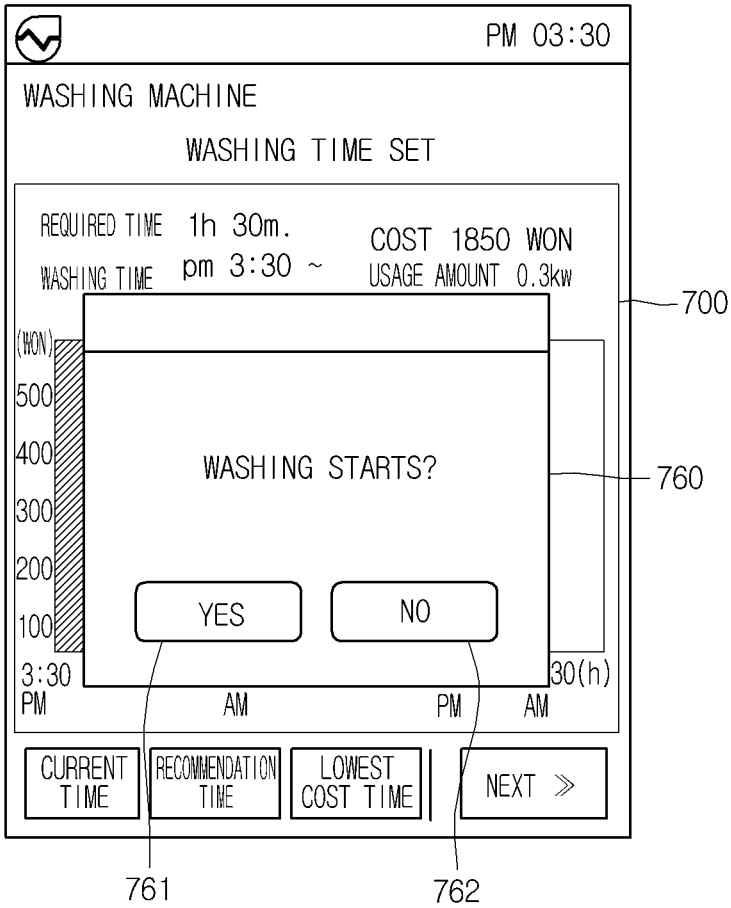
FIG. 46 is a view illustrating an example of a displayed screen when a next selection part is selected on the screen of FIG. 44.

FIG. 46 is a view illustrating an example of a displayed screen when a next selection part is selected on the screen of FIG. 44.

Referring to FIGS. 44 and 46, when the next selection part 754 is selected on the screen of FIG. 44, a washing start confirmation screen 760 may be displayed on the second screen 700. A first selection part 761 for inputting a washing start command and a second selection part 762 for inputting a non-washing start command may be displayed on the washing start confirmation screen 760. When the second selection part 762 is selected, the screen of FIG. 46 may be switched into the previous screen or the screen of FIG. 41, 42, or 44.

Figure 47:
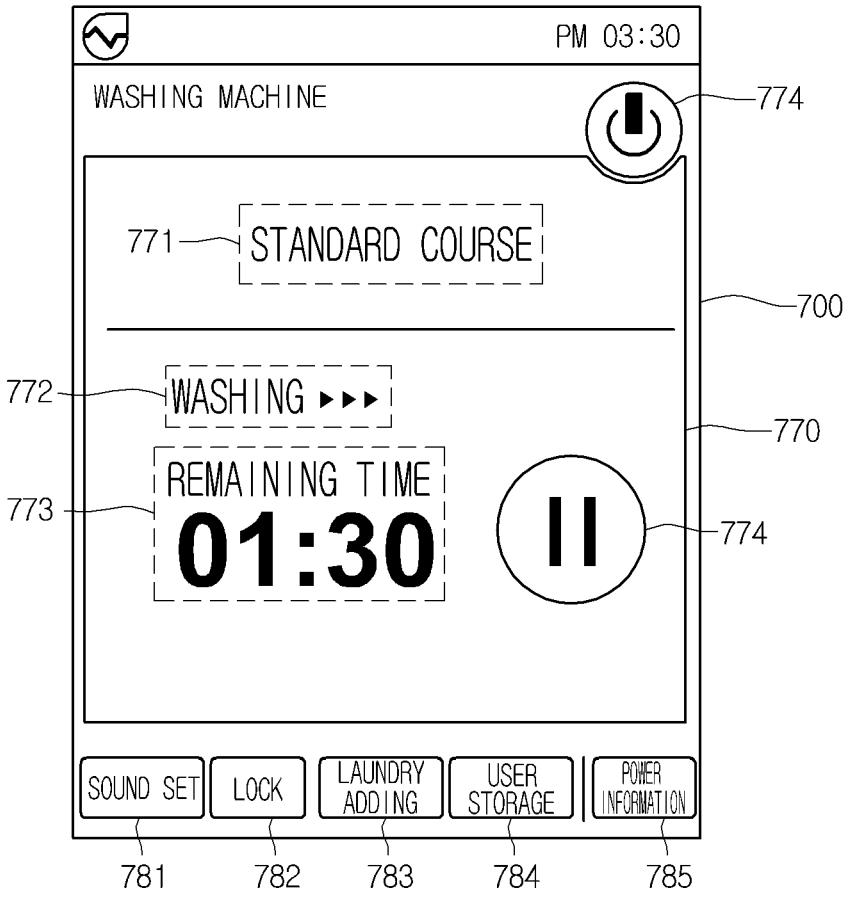
FIG. 47 is a view illustrating an example of a displayed screen when a start command is inputted on the screen of FIG. 46.

FIG. 47 is a view illustrating an example of a displayed screen when a start command is inputted on the screen of FIG. 46.

Referring to FIGS. 46 and 47, when the start command is inputted on the screen of FIG. 46, information screen 770 related to an operation of the washing machine may be displayed on the second serene 700. That is, when the start command is inputted in a state where the course and washing time are decided, the information screen 770 related to the operation of the washing machine may be displayed on the second screen 700. Also, at least one of an on/off selection part 742 and a temporary stop selection part 774 may be displayed on the second screen 700.

Also, at least one of a sound set selection part 781, a locking selection part 782, a laundry adding selection part 783, a user storage selection part 784, and a power information selection part 785 may be additionally displayed on the second screen 700.

At least one of selected course information 771, the current state information 773, and remaining time information 772 may be displayed on the operation-related information screen 770. For example, FIG. 47 illustrates a screen on which the selected course information 771, the remaining time information 772, and the current state information 773 are displayed on the operation-related information screen 770.

Here, the remaining time information 773 may be time information remaining from the current time until the washing process is completed. Here, the remaining time information 773 may be time information remaining from the current time until the washing process is completed even though the washing start time is after the current time. For example, when the current time is about 3:30 P.M., a washing required time is about 1 hour, and a washing start time is the current time, the remaining time information 773 may be about 1 hour. For another example, when the current time is about 3:30 P.M., a washing required time is about 1 hour, and a washing start time is about 4:30 P.M, the remaining time information 773 may be about 2 hour. On the other hand, when the washing start time is not the current time, predicted washing start time information may be displayed till the washing start time. Then, when the washing starts, the remaining time information 773 may be displayed.

The washing machine may perform at least washing, rinsing, and dehydration processes. The current state information 772 may be current progressing course information when the washing is progressed. On the other hand, when the washing process is on standby (when the washing start time is after the current time), the current state information 772 may be information for informing on standby or reservation. The current progressing course information may include at least one of character information and level information for displaying the current progressing status into a level.

When the sound set selection part 781 is selected, sound generated from the washing machine may be set or changed in kind or intensity. When the locking selection part 782 is selected, a door may be locked.

Figure 48:
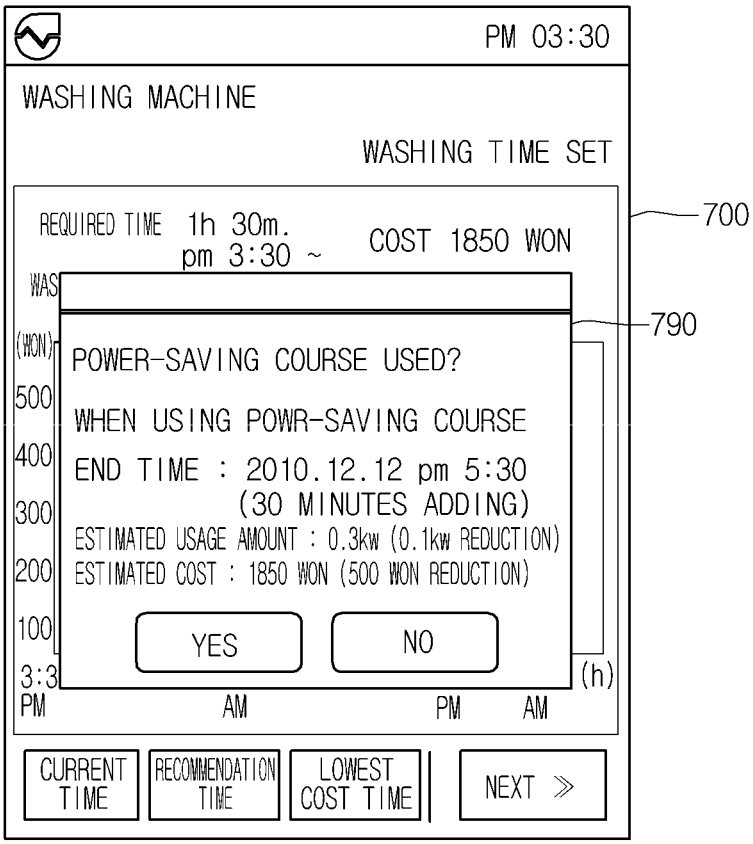
FIG. 48 is a view illustrating an example of a displayed screen when a current time selection part is selected on the screen of FIG. 44 or 45.

FIG. 48 is a view illustrating an example of a displayed screen when a current time selection part is selected on the screen of FIG. 44 or 45.

Referring to FIG. 48, when the current time selection part 751 is selected on the screen of FIG. 44 or 45, in a case where power cost of the current time is expensive than mean power cost during a certain time from the current time, a power-saving course selection screen 790 may be displayed on the second screen 700. Here, for example, the certain time may be about 24 hours. The present disclosure is not limited to the certain time, and also, the certain time may be manually or automatically changed or set.

At least one of information of the changed washing end time and changed time content, an estimated power usage amount, a reduced power amount when compared that the course and time selected by the user are operated, estimated cost information, and reduced power cost when compared that the course and time selected by the user are operated may be displayed on the power-saving course selection screen 790.

In the current embodiment, the power-saving course may be a course in which an operation condition of the selected course is changed. For example, when the user selects a standard course and inputs an operation condition using the operation condition input part, the power-saving course may represent a course in which the selected operation condition is changed. For another example, the power-saving course may be one of plurality of courses except for the selected course.

The user may select whether the power-saving course is performed on the power-saving course selection screen. When the power-saving course is selected, the laundry handling apparatus may perform the selected power-saving course.

On the other hand, when the power-saving course is not selected, the screen of FIG. 48 may be switched into the previous screen or the washing machine may be operated on the basis of the information set by the user.

Figure 49:
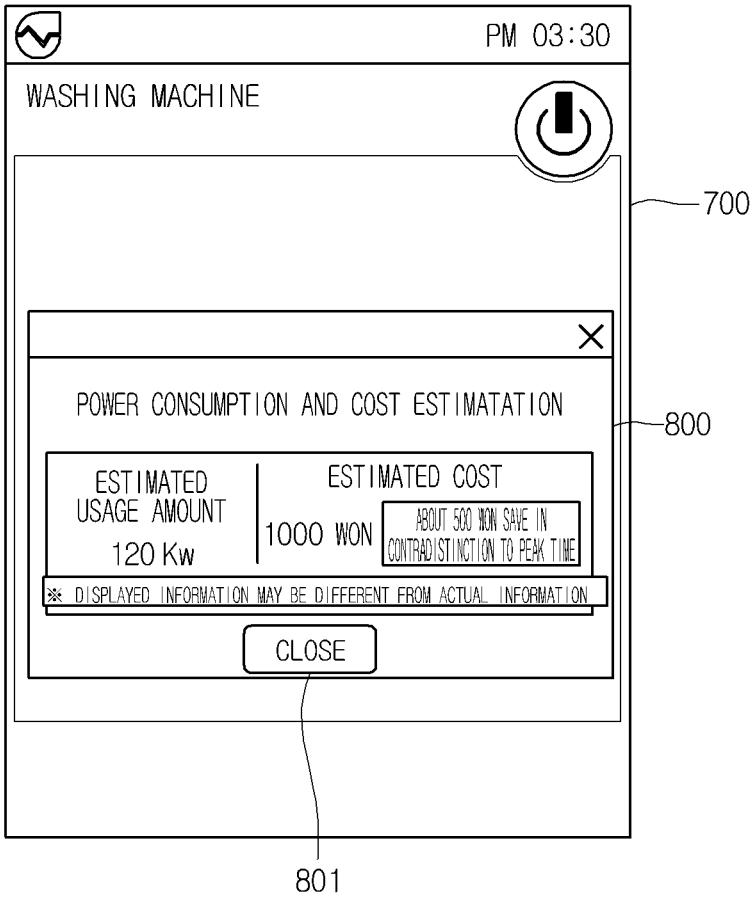
FIG. 49 is a view illustrating an example of a displayed screen when a power information selection part is selected on the screen of FIG. 47.

FIG. 49 is a view illustrating an example of a displayed screen when a power information selection part is selected on the screen of FIG. 47.

Referring to FIGS. 47 and 49, when the power information selection part 785 is selected on the screen of FIG. 47, a power information confirmation screen 800 may be displayed on the second screen 700. At least one of an estimated power usage amount, estimated power usage cost, saved cost when compared to that of a peak time (a time zone at which power cost is expensive) may be displayed on the power information confirmation screen 800. If the current time, at which the washing process is progressed, is a peak time and the power-saving course is not selected, saved cost may be about zero won.

According to the current embodiment, since the communication component recognizes the power cost, the power cost may be displayed on the display part. Thus, the user may operate the laundry handling apparatus in a time zone at which the power cost is inexpensive to reduce the power usage cost.

Also, since the communication component may communicate with the laundry handling apparatus by the communication module, the laundry handling apparatus may be controlled by the communication component irrespective of a distance.

Also, since the operation state of the laundry handling apparatus may be confirmed through the communication component, the laundry handling apparatus may be more effectively controlled (managed).

Although the washing machine is described an example, the contents with respect to the washing machine may be equally applied to a dryer.

Figure 50:
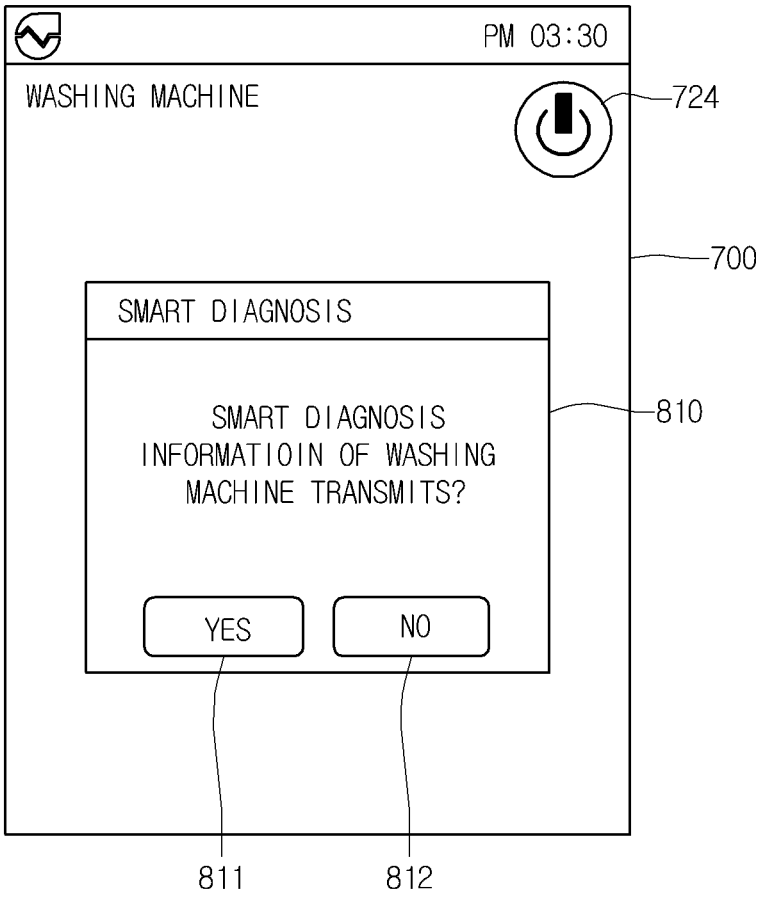
FIG. 50 is a view illustrating an example of a displayed screen when a smart diagnosis request selection part is selected on the screen of FIG. 41.

FIG. 50 is a view illustrating an example of a displayed screen when a smart diagnosis request part is selected on the screen of FIG. 41.

Referring to FIG. 50, when the smart diagnosis request part 725 is selected on the screen of FIG. 41, an information transmission confirmation screen 810 may be displayed on the second screen 700. A first selection part 810 which is selected for performing the information transmission and a second selection part 811 for canceling the information may be displayed on the information transmission confirmation screen 810. When the second selection part 812 is selected, for example, the current screen may be switched into the screen of FIG. 5. An on/off selection part 724 may be additionally displayed on the second screen 700.

Figure 51:
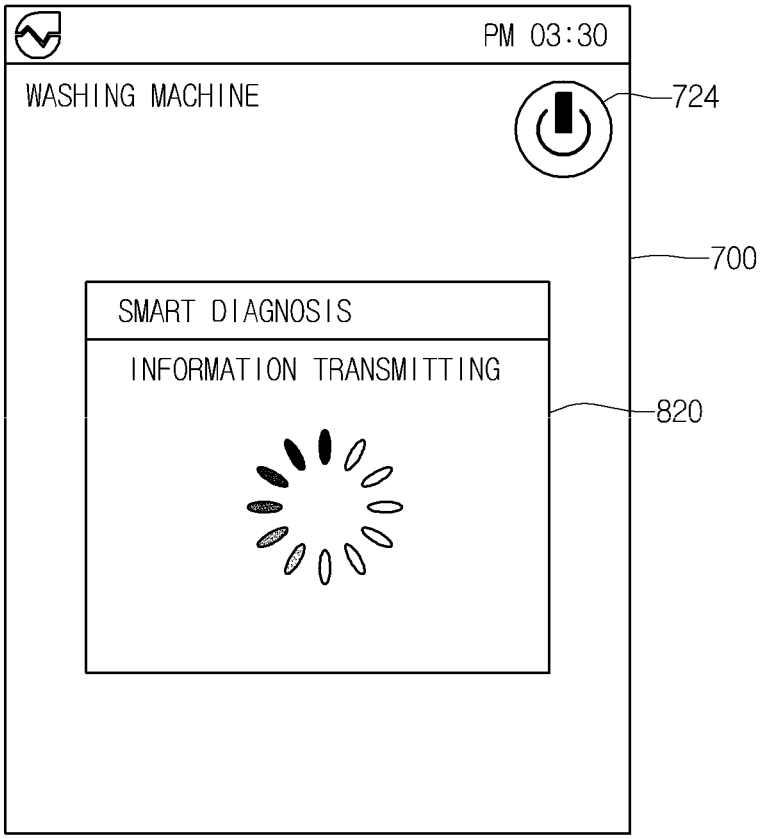
FIG. 51 is a view illustrating an example of a displayed screen when a selection part for transmitting information is selected on the screen of FIG. 50.

FIG. 51 is a view illustrating an example of a displayed screen when a selection part for transmitting information is selected on the screen of FIG. 50.

Referring to FIGS. 50 and 51, when the first selection part 811 is selected on the screen of FIG. 50, information transmission status information 820 may be displayed on the second screen 700. The information transmission status information 820 may include at least one of level information for displaying information transmission status by degrees, and information about time remaining until the transmission is completed. The on/off selection part 724 may be additionally displayed on the second screen 700.

When the first selection part 811 for performing the information transmission is selected on the screen of FIG. 50, status information of a specific component (e.g., the laundry handling apparatus) may be transmitted to the above-described server. For another example, when the first selection part 811 for selecting the information transmission is selected, status information of a specific component may be transmitted to the above-described communication component. The diagnosis of the specific component may be performed by the server or the communication component 2.

Figure 52:
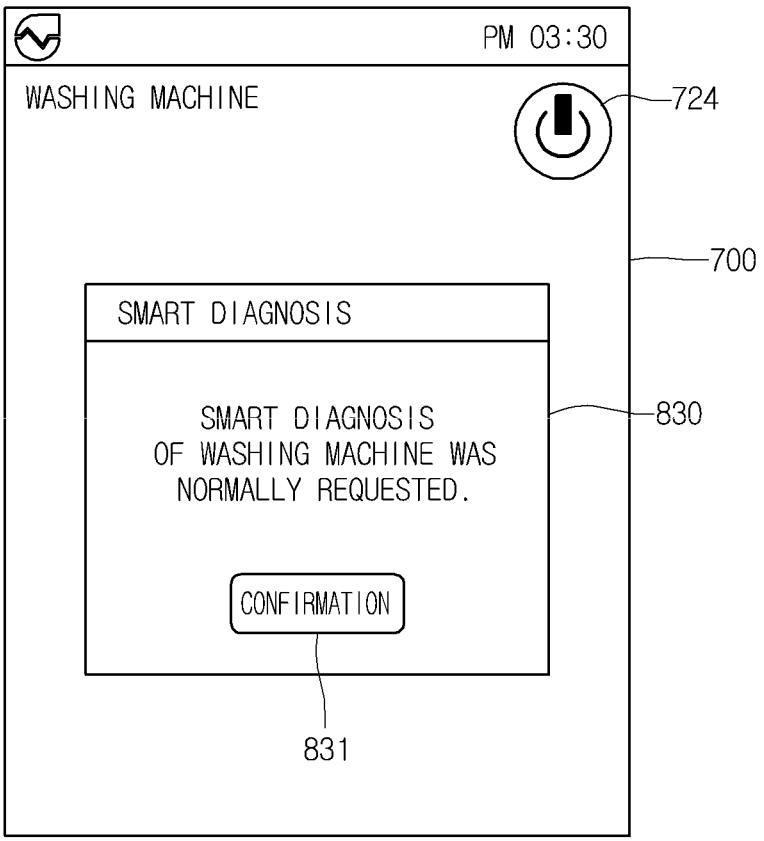
FIG. 52 is a view illustrating an example of a displayed screen when the information transmission is completed on the screen of FIG. 51.
Figure 53:
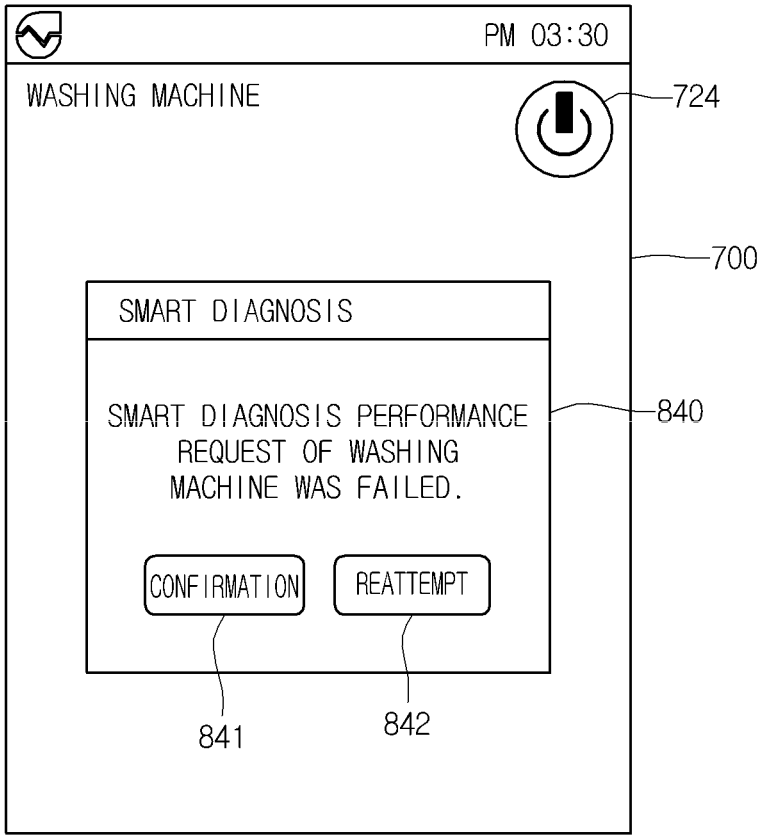
FIG. 53 is a view illustrating an example of a displayed screen when the information transmission is failed on the screen of FIG. 51.

FIG. 52 is a view illustrating an example of a displayed screen when the information transmission is completed on the screen of FIG. 51. FIG. 53 is a view illustrating an example of a displayed screen when the information transmission is failed on the screen of FIG. 51.

Referring to FIG. 52, when the information transmission is completed on the screen of FIG. 51, an information transmission completion screen 830 may be displayed on the second screen 700. Also, a confirmation selection part 831 may be displayed on the information transmission completion screen 830. When the confirmation selection part 831 is displayed, the screen of FIG. 52 may be switched into the screen of FIG. 41.

When the diagnosis is completed, diagnosis result information (not shown) may be displayed on the screen of FIG. 41, or the diagnosis result information may be displayed on the screen of FIG. 41 even though the current screen is switched into the screen of FIG. 41.

Referring to FIG. 53, when the information transmission is failed on the screen of FIG. 51, an information transmission fail confirmation screen 840 may be displayed. A confirmation selection part 841 which is selected for canceling the diagnosis and a reattempt selection part 842 which is selected for reattempting the information transmission may be displayed on the information transmission fail confirmation screen 840. When the confirmation selection part 841 is selected, the screen of FIG. 53 may be switched into the screen of FIG. 41. When the reattempt selection part 842 is selected, the information transmission may be reattempted.

According to the embodiment, the communication component may perform diagnosis request of a specific component and the performed diagnosis result may be displayed on the communication component, the user may easily confirm the error of the specific component.

Figure 54:
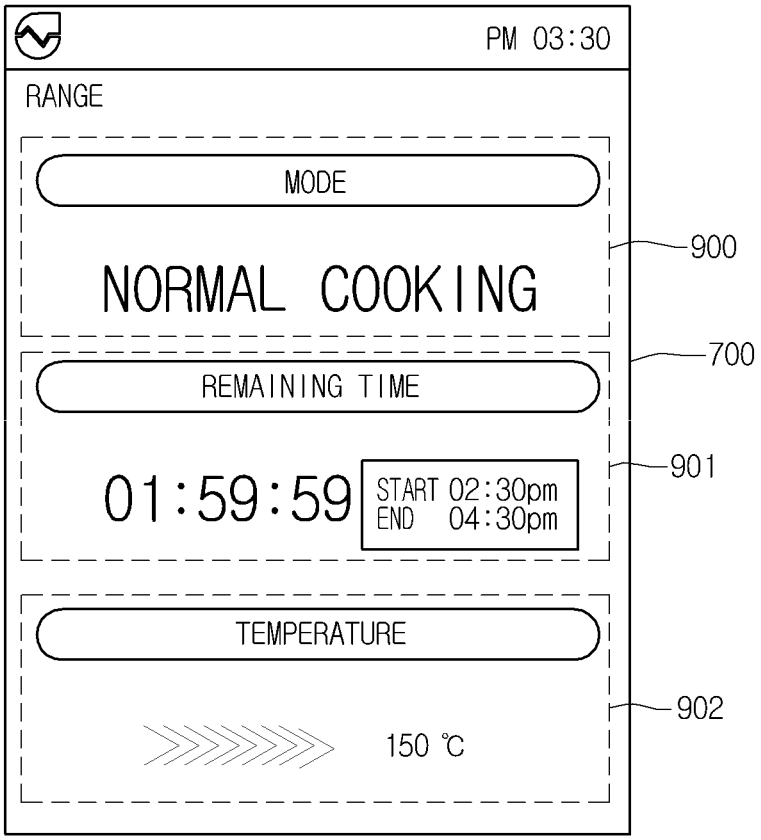
FIGS. 54 and 55 are views illustrating an example of a displayed screen when a specific component selection part is selected on the screen of FIG. 38.
Figure 55:
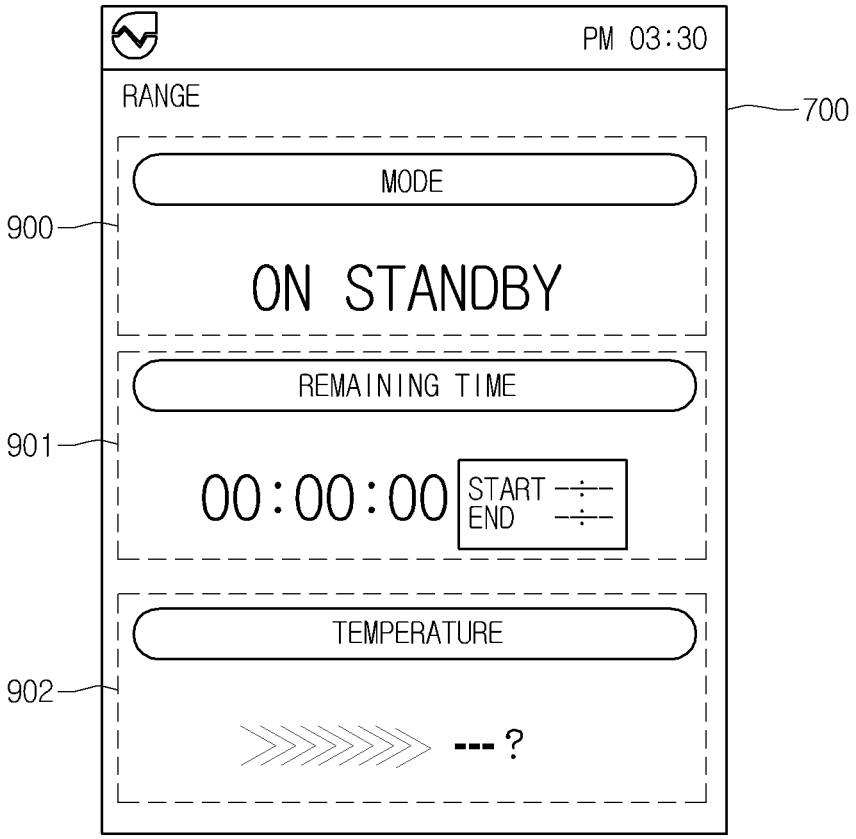

FIGS. 54 and 55 are views illustrating an example of a displayed screen when a specific component selection part is selected on the screen of FIG. 38. FIGS. 54 and 55 illustrate a screen in which a range is selected as an example.

Referring to FIGS. 38, 54, and 54, when a specific component selection part (e.g., a range selection part) is selected on the screen of FIG. 38, at least one of a mode information screen 900 and a remaining time information screen 901 may be displayed on the second screen 700. A cooking temperature information screen 902 may be further displayed on the second screen 700.

The range may be one kind of cooking appliance. Thus, the present disclosure is not limited to the range, and thus information related to various types of cooking appliance may be displayed.

Referring to FIG. 54, when the range is operated, the current operation mode may be displayed on the mode information screen 900. At least one of time information until the cooking is completed, a cooking start time, and a cooking end time may be displayed on the remaining time information screen 901.

Referring to FIG. 55, when the range is not operated, information for noticing on standby may be displayed on the mode information screen 900. The remaining time may not be displayed on the remaining time information screen 901, and the cooking temperature may not be displayed on the cooking temperature information screen 903.

When the mode information screen 900 is selected, a user may select an operation mode of the range. Thus, the remaining time information screen 901 may be selected to set an operation time of the range. Also, the cooking temperature information screen 902 may be selected to set a cooking temperature of the range.

Although the laundry handling apparatus or the range is described as an example, the communication component may remotely control components in addition to the above-described laundry handling apparatus or the range or perform monitoring and diagnosis request, etc.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. A laundry handling apparatus comprising:

a display part for displaying information;

a control part for controlling the display part; and a communication part to receive an energy information including information related to electricity, water or gas, wherein, when the display part is turned on, a plurality of screens divided according to contents are displayed on the display part, and at least one of a course selection screen for selecting a course selection and a function selection part for selecting an additional function except for the course selection is displayed on one of the plurality of screens, when a smart grid function is turned on, the laundry handling apparatus is operated on the basis of the energy information, wherein the plurality of screens comprise a first screen and a second screen, the first screen displays date information, time information, smart grid function on/off information, and the second screen displays the course selection screen and the function selection part.

2. The laundry handling apparatus according to claim 1, wherein the smart grid function on/off information is differently displayed according to function on/off states.

3. The laundry handling apparatus according to claim 2, wherein, when a boundary between the first screen and the second screen or an upper portion of the second screen is touched and pulled down, or when the smart grid function on/off information is selected, a smart grid information screen for selecting an on or off state of the smart grid function is displayed.

4. The laundry handling apparatus according to claim 1, wherein an operation time set screen for setting an operation time after a specific course is selected is displayed on the course selection screen.

5. The laundry handling apparatus according to claim 4, wherein, when the specific course is selected and a start command is inputted, the operation time set screen is displayed.

6. The laundry handling apparatus according to claim 4, wherein the operation time set screen displays at least one of a power cost information screen, operation-related time information, and operation-related power information.

7. The laundry handling apparatus according to claim 6, wherein the power cost information screen displays power-related graph information and an operation time display part for displaying an operation time.

8. The laundry handling apparatus according to claim 7, wherein a start time or an end time constituting the operation time is changed, and the operation time display part is changed according to a change of the operation time.

9. The laundry handling apparatus according to claim 4, wherein the operation time set screen displays the current time selection part for setting the operation time as the current time and one or more recommendation selection part for setting the operation time as a recommended time.

10. The laundry handling apparatus according to claim 9, wherein, when the one or more recommendation selection part is selected, a time zone in which power cost is the lowest within a certain time range from the current time is displayed.

11. The laundry handling apparatus according to claim 1, further comprising a smart function selection part for selecting a smart function, wherein the smart function comprises at least one of a smart grid function, a smart diagnosis function, and a software download function.

12. The laundry handling apparatus according to claim 11, wherein, when the smart grid function is turned on, the display part is operated on the basis of energy information.

13. The laundry handling apparatus according to claim 11, wherein, when the smart grid function is selected in a state where the smart grid function is turned off, a smart grid off notice screen is displayed.

14. The laundry handling apparatus according to claim 11, wherein, when the smart grid function is selected in a state where the smart grid function is turned on, a power-related information screen is displayed.

15. The laundry handling apparatus according to claim 14, wherein the power-related information screen comprises at least one of a power cost screen, a power usage cost screen, and a power usage amount screen.

16. The laundry handling apparatus according to claim 15, wherein one screen of the power cost screen, the power usage cost screen, and the power usage amount screen is switched into the other screen.

17. The laundry handling apparatus according to claim 11, wherein, when the smart diagnosis function is selected, a diagnosis result is displayed on the display part.

18. The laundry handling apparatus according to claim 11, wherein, the software download function is selected, new update information received from the outside is displayed on the display part.

* * * * *